US011332804B2

(12) United States Patent
Tsuchihashi et al.

(10) Patent No.: US 11,332,804 B2
(45) Date of Patent: May 17, 2022

(54) HIGH-STRENGTH COLD-ROLLED STEEL SHEET, HIGH-STRENGTH COATED STEEL SHEET, AND METHOD FOR PRODUCING THE SAME

(71) Applicant: JFE STEEL CORPORATION, Tokyo (JP)

(72) Inventors: Seigo Tsuchihashi, Tokyo (JP); Shinsuke Komine, Tokyo (JP); Tatsuya Nakagaito, Tokyo (JP); Hidekazu Minami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 63 days.

(21) Appl. No.: 16/966,762

(22) PCT Filed: Jan. 21, 2019

(86) PCT No.: PCT/JP2019/001664
§ 371 (c)(1),
(2) Date: Jul. 31, 2020

(87) PCT Pub. No.: WO2019/151017
PCT Pub. Date: Aug. 8, 2019

(65) Prior Publication Data

US 2021/0040577 A1 Feb. 11, 2021

(30) Foreign Application Priority Data

Jan. 31, 2018 (JP) ..... JP2018-015610

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/20*** | (2006.01) |
| ***C22C 38/32*** | (2006.01) |
| ***C22C 38/60*** | (2006.01) |
| ***C23C 2/06*** | (2006.01) |

(52) U.S. Cl.
CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/105* (2013.01); *C22C 38/12* (2013.01); *C22C 38/14* (2013.01); *C22C 38/20* (2013.01); *C22C 38/32* (2013.01); *C22C 38/60* (2013.01); *C23C 2/06* (2013.01); *C21D 2211/001* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 2011/0008546 | A1 | 1/2011 | Suzuki et al. |
| 2013/0133792 | A1 | 5/2013 | Nakagaito et al. |
| 2014/0170439 | A1 | 6/2014 | Allain et al. |
| 2014/0182748 | A1 | 7/2014 | Nakagaito et al. |
| 2016/0237520 | A1 | 8/2016 | Murata et al. |
| 2019/0003008 | A1 | 1/2019 | Gospodinova et al. |

FOREIGN PATENT DOCUMENTS

| | | | |
|---|---|---|---|
| CN | 103620063 | A | 3/2014 |
| CN | 103882320 | A | 6/2014 |
| CN | 105452513 | A | 3/2016 |
| EP | 2 546 368 | A1 | 1/2013 |
| EP | 3 012 339 | A1 | 4/2016 |

(Continued)

OTHER PUBLICATIONS

Nov. 19, 2020 Extended Search Report issued in European Patent Application No. 19748001.5.
Dec. 15, 2021 Office Action issued in Korean Patent Application No. 2020-7022068.
May 28, 2021 Office Action issued in Chinese Patent Application No. 201980010927.4.
Aug. 2, 2019 International Search Report issued in International Application No. PCT/JP2019/001664.

*Primary Examiner* — Jophy S. Koshy
(74) *Attorney, Agent, or Firm* — Oliff PLC

(57) ABSTRACT

A high-strength cold-rolled steel sheet or high-strength coated steel sheet that has a tensile strength (TS) of 780 MPa or more and has high ductility, stretch-flangeability, and in-plane stability of stretch-flangeability and methods for producing the same. The high-strength cold-rolled steel sheet has a specified chemical composition and a microstructure comprising, by area fraction, in a range of 50% to 80% of ferrite, 8% or less of martensite with an average grain size of 2.5 μm or less, in a range of 6% to 15% of retained austenite, and in a range of 3% to 40% of tempered martensite. A ratio $f_M/f_{M+TM}$ being 50% or less, where $f_M$ denotes the area fraction of martensite and $f_{M+TM}$ denotes the total area fraction of martensite and tempered martensite, and a standard deviation of the grain size of martensite at certain portions being 0.7 μm or less.

12 Claims, No Drawings

(56) References Cited

FOREIGN PATENT DOCUMENTS

| | | | |
|---|---|---|---|
| JP | 2003-171735 | A | 6/2003 |
| JP | 2006-104532 | A | 4/2006 |
| JP | 2008-291304 | A | 12/2008 |
| JP | 2011-140695 | A | 7/2011 |
| JP | 2015-113504 | A | 6/2015 |
| JP | 2016-031165 | A | 3/2016 |
| KR | 10-1422556 | B1 | 7/2014 |
| WO | 2009/081997 | A1 | 7/2009 |
| WO | 2013/051238 | A1 | 4/2013 |
| WO | 2015/046364 | A1 | 4/2015 |
| WO | 2017/108866 | A1 | 6/2017 |
| WO | 2018/030500 | A1 | 2/2018 |

HIGH-STRENGTH COLD-ROLLED STEEL SHEET, HIGH-STRENGTH COATED STEEL SHEET, AND METHOD FOR PRODUCING THE SAME

TECHNICAL FIELD

This application relates to a high-strength cold-rolled steel sheet or high-strength coated steel sheet with high formability suitable mainly for structural members of automobiles and a method for producing the high-strength cold-rolled steel sheet or high-strength coated steel sheet. In particular, this application relates to a high-strength cold-rolled steel sheet or high-strength coated steel sheet that has a tensile strength (TS) of 780 MPa or more and has high ductility, stretch-flangeability, and in-plane stability of stretch-flangeability, and a method for producing the high-strength cold-rolled steel sheet or high-strength coated steel sheet.

BACKGROUND

In recent years, with a growing demand for improved crash safety and fuel consumption of automobiles, high-strength steels have been increasingly used. Automotive steel sheets to be formed into automotive parts by press forming or burring are required to have high formability. Thus, automotive steel sheets are required to have high ductility and stretch-flangeability while retaining high strength. Under such circumstances, various high-strength steel sheets with high formability have been developed. However, an increase in alloying element content for the purpose of high strengthening results in in-plane variations in formability, particularly in stretch-flangeability, thus resulting in materials with unsatisfactory characteristics.

Patent Literature 1 discloses a technique related to a high-strength steel sheet with high ductility and stretch-flangeability that has a tensile strength in the range of 528 to 1445 MPa. Patent Literature 2 discloses a technique related to a high-strength steel sheet with high ductility and stretch-flangeability that has a tensile strength in the range of 813 to 1393 MPa. Patent Literature 3 discloses a technique related to a high-strength hot-dip galvanized steel sheet with high stretch-flangeability, in-plane stability of stretch-flangeability, and bendability that has a tensile strength in the range of 1306 to 1631 MPa.

CITATION LIST

Patent Literature

PTL 1: Japanese Unexamined Patent Application Publication No. 2006-104532

PTL 2: Domestic Re-publication of PCT International Publication for Patent Application No. 2013-51238

PTL 3: Japanese Unexamined Patent Application Publication No. 2016-031165

SUMMARY

Technical Problem

Although Patent Literature 1 and Patent Literature 2 describe a microstructure for high ductility and stretch-flangeability and the production conditions for forming the microstructure, they do not consider and leave room for improved in-plane variations in material quality. Although Patent Literature 3 describes in-plane stability of stretch-flangeability, Patent Literature 3 does not consider a steel sheet with high ductility as well as good stretch-flangeability and does not describe a cold-rolled steel sheet.

In view of such situations, the disclosed embodiments aim to provide a high-strength cold-rolled steel sheet or high-strength coated steel sheet that has a tensile strength (TS) of 780 MPa or more and has high ductility, stretch-flangeability, and in-plane stability of stretch-flangeability and an effective method for producing the high-strength cold-rolled steel sheet or high-strength coated steel sheet. In the disclosed embodiments, high ductility or total elongation (El) refers to the product of TS and El being 20000 (MPa x %) or more, high stretch-flangeability or hole expandability refers to the product of TS and the hole expanding ratio (k) being 30000 (MPa x %) or more, and high in-plane stability of stretch-flangeability refers to the standard deviation of the hole expanding ratio (k) in the sheet width direction being 4% or less.

Solution to Problem

As a result of repeated investigations to produce a high-strength cold-rolled steel sheet that has a tensile strength (TS) of 780 MPa or more and has high ductility, stretch-flangeability, and in-plane stability of stretch-flangeability, the present inventors have obtained the following findings.

It was found that the cooling rate in a cooling process after annealing in a ferrite+austenite two-phase region can be controlled to optimally control the ferrite fraction in the microstructure after annealing. It was also found that, in the course of cooling to the martensitic transformation start temperature or lower in the cooling process and subsequent heating to an upper bainite forming temperature range for soaking, the cooling stop temperature in the range of (Ms—100° C.) to Ms and the second soaking temperature in the range of 350° C. to 500° C. can be controlled to optimally control the tempered martensite, retained austenite, and martensite fractions in the microstructure after annealing. It was also found that the coiling temperature in the sheet width direction, the cooling stop temperature, and the second soaking temperature can be controlled to ensure in-plane stability of stretch-flangeability. As a result, a high-strength cold-rolled steel sheet that has TS of 780 MPa or more and has high ductility, stretch-flangeability, and in-plane stability of stretch-flangeability can be produced. The disclosed embodiments are based on these findings. The following is the gist of the disclosed embodiments.

[1] A high-strength cold-rolled steel sheet that has a composition of C: 0.060% to 0.250%, Si: 0.50% to 1.80%, Mn: 1.00% to 2.80%, P: 0.100% or less, S: 0.0100% or less, Al: 0.010% to 0.100%, and N: 0.0100% or less, on a mass percent basis, the remainder being Fe and incidental impurities, and that has a steel microstructure containing 50% to 80% by area of ferrite, 8% or less by area of martensite with an average grain size of 2.5 μm or less, 6% to 15% by area of retained austenite, and 3% to 40% by area of tempered martensite, the ratio $f_M/f_{M+TM}$ being 50% or less, wherein $f_M$ denotes the area fraction of martensite and $f_{M+TM}$ denotes the total area fraction of martensite and tempered martensite, and the standard deviation of the grain size of martensite at five portions being 0.7 μm or less, the five portions being a width central portion at the center in a sheet width direction, end portions 50 mm inside each end in the sheet width direction, and middle portions between the width central portion and the end portions.

[2] The high-strength cold-rolled steel sheet according to [1], wherein the composition further contains at least one element selected from the group consisting of Mo: 0.01% to 0.50%, B: 0.0001% to 0.0050%, and Cr: 0.01% to 0.50%, on a mass percent basis.

[3] The high-strength cold-rolled steel sheet according to [1] or [2], wherein the composition further contains at least one element selected from the group consisting of Ti: 0.001% to 0.100%, Nb: 0.001% to 0.050%, and V: 0.001% to 0.100%, on a mass percent basis.

[4] The high-strength cold-rolled steel sheet according to any one of [1] to [3], wherein the composition further contains at least one element selected from the group consisting of Cu: 0.01% to 1.00%, Ni: 0.01% to 0.50%, As: 0.001% to 0.500%, Sb: 0.001% to 0.100%, Sn: 0.001% to 0.100%, Ta: 0.001% to 0.100%, Ca: 0.0001% to 0.0100%, Mg: 0.0001% to 0.0200%, Zn: 0.001% to 0.020%, Co: 0.001% to 0.020%, Zr: 0.001% to 0.020%, and REM: 0.0001% to 0.0200%, on a mass percent basis.

[5] A high-strength coated steel sheet including the high-strength cold-rolled steel sheet according to any one of [1] to [4] and a coated layer formed on the high-strength cold-rolled steel sheet.

[6] The high-strength coated steel sheet according to [5], wherein the coated layer is a hot-dip coated layer or an alloyed hot-dip coated layer.

[7] A method for producing a high-strength cold-rolled steel sheet, including: a hot rolling step of heating a steel slab with the composition described in any one of [1] to [4] to a temperature in the range of 1100° C. to 1300° C., hot rolling the steel slab at a finish rolling exit temperature in the range of 800° C. to 950° C., and coiling the hot-rolled sheet at a coiling temperature in the range of 300° C. to 700° C. and at a difference of 70° C. or less in coiling temperature in a temperature distribution in a sheet width direction; after the hot rolling step, a cold rolling step of cold rolling the hot-rolled sheet at a rolling reduction of 30% or more; after the cold rolling step, a first soaking step of heating the cold-rolled sheet to a first soaking temperature in the range of T1 to T2, and cooling the cold-rolled sheet at an average cooling rate to 500° C. of 10° C./s or more to a cooling stop temperature in the range of (Ms—100° C.) to Ms, wherein Ms denotes a martensitic transformation start temperature, a difference in cooling stop temperature in the temperature distribution in the sheet width direction during the cooling being 30° C. or less; and after the first soaking step, a second soaking step of reheating the sheet to a second soaking temperature in the range of 350° C. to 500° C., soaking the sheet for 10 seconds or more at a difference of 30° C. or less in second soaking temperature in the temperature distribution in the sheet width direction during the reheating, and cooling the sheet to room temperature, wherein $$Ms\ (^\circ C.)=539-423\times\{[\%\ C]/(1-[\%\ \alpha]/100)\}-30\times[\%\ Mn]-12\times[\%\ Cr]-18\times[\%\ Ni]-8\times[\%\ Mo]$$

$$\text{Temperature } T1\ (^\circ C.)=751-27\times[\%\ C]+18\times[\%\ Si]-12\times[\%\ Mn]-169\times[\%\ Al]-6\times[\%\ Ti]+24\times[\%\ Cr]-895\times[\%\ B]$$

$$\text{Temperature } T2\ (^\circ C.)=937-477\times[\%\ C]+56\times[\%\ Si]-20\times[\%\ Mn]+198\times[\%\ Al]+136\times[\%\ Ti]-5\times[\%\ Cr]+3315\times[\%\ B]$$

[% X] in the formulae denotes a component element X content (% by mass) of the steel sheet, and [% α] denotes the ferrite fraction at Ms during the cooling.

[8] A method for producing a high-strength coated steel sheet, including a coating step of coating a high-strength cold-rolled steel sheet produced by the method for producing a high-strength cold-rolled steel sheet according to [7].

[9] The method for producing a high-strength coated steel sheet according to [8], further including an alloying step of performing alloying treatment after the coating step.

Advantageous Effects

The disclosed embodiments can provide a high-strength cold-rolled steel sheet or high-strength coated steel sheet that has TS of 780 MPa or more and has high ductility, stretch-flangeability, and in-plane stability of stretch-flangeability, and a method for producing the high-strength cold-rolled steel sheet or high-strength coated steel sheet. A high-strength cold-rolled steel sheet produced by a method according to the disclosed embodiments can improve fuel consumption due to the weight reduction of automotive bodies when used in automobile structural members, for example, and has significantly high industrial utility value.

DETAILED DESCRIPTION

Disclosed embodiments are described below. This disclosure is not limited to these embodiments.

First, the composition of a high-strength cold-rolled steel sheet according to the disclosed embodiments is described below. In the following description, "%" in the composition refers to % by mass.

C: 0.060% to 0.250%

C is a base component of steel, contributes to the formation of hard phases of tempered martensite, retained austenite, and martensite in the disclosed embodiments, and particularly has an influence on the area fractions of martensite and retained austenite. Thus, C is an important element. The mechanical characteristics, such as strength, of the resulting steel sheet depend significantly on the fraction, shape, and average size of martensite. A C content of less than 0.060% results in an insufficient fraction of bainite, tempered martensite, retained austenite, or martensite and difficulty in achieving a good balance between the strength and elongation of the steel sheet. Thus, the C content is 0.060% or more, preferably 0.070% or more, more preferably 0.080% or more. On the other hand, a C content of more than 0.250% results in low local ductility due to the formation of coarse carbide and results in low ductility and stretch-flangeability. Thus, the C content is 0.250% or less, preferably 0.220% or less, more preferably 0.200% or less.

Si: 0.50% to 1.80%

Si is an important element that suppresses the formation of carbide during bainite transformation and contributes to the formation of retained austenite. To form a required fraction of retained austenite, the Si content is 0.50% or more, preferably 0.80% or more, more preferably 1.00% or more. On the other hand, an excessively high Si content results in low chemical conversion treatability and low ductility due to solid-solution strengthening. Thus, the Si content is 1.80% or less, preferably 1.60% or less, more preferably 1.50% or less.

Mn: 1.00% to 2.80%

Mn is an important element that causes solid-solution strengthening, promotes the formation of a hard phase, and contributes to high strengthening. Mn is an element that stabilizes austenite and contributes to a controlled hard phase fraction. The Mn content required therefor is 1.00% or more, preferably 1.30% or more, more preferably 1.50% or more. On the other hand, an excessively high Mn content results in an excessively high martensite fraction, high tensile strength, and low stretch-flangeability. Thus, the Mn content is 2.80% or less, preferably 2.70% or less, more preferably 2.60% or less.

P: 0.100% or less

A P content of more than 0.100% results in embrittlement of a grain boundary due to segregation at the ferrite grain boundary or the phase interface between ferrite and martensite, low impact resistance, low local elongation, low ductility, and low stretch-flangeability. Thus, the P content is 0.100% or less, preferably 0.050% or less. The P content has no particular lower limit but is preferably minimized. An excessively low P content, however, results in enormous costs. Thus, the P content is preferably 0.0003% or more in terms of production costs.

S: 0.0100% or less

S is an element that forms sulfide, such as MnS, and decreases local deformability, ductility, and stretch-flangeability. Thus, the S content is 0.0100% or less, preferably 0.0050% or less. The S content has no particular lower limit but is preferably minimized. An excessively low S content, however, results in enormous costs. Thus, the S content is preferably 0.0001% or more in terms of production costs.

Al: 0.010% to 0.100%

Al is an element that is added as a deoxidizer in a steelmaking process. To achieve this effect, the Al content is 0.010% or more, preferably 0.020% or more. On the other hand, an Al content of more than 0.100% results in a defect on the surface and in the interior of a steel sheet due to an increased number of inclusions, such as alumina, and results in low ductility. Thus, the Al content is 0.100% or less, preferably 0.070% or less.

N: 0.0100% or less

N causes aging degradation, forms coarse nitride, and decreases ductility and stretch-flangeability. Thus, the N content is 0.0100% or less, preferably 0.0070% or less. The N content has no particular lower limit but is preferably 0.0005% or more in terms of melting costs.

The composition of a high-strength cold-rolled steel sheet according to the disclosed embodiments may contain the following elements as optional elements. The following optional elements below their lower limits, if present, do not reduce the advantages of the disclosed embodiments and are considered to be incidental impurities.

At least one selected from the group consisting of Mo: 0.01% to 0.50%, B: 0.0001% to 0.0050%, and Cr: 0.01% to 0.50%

Mo is an element that promotes the formation of a hard phase without impairing chemical conversion treatability and contributes to high strengthening. To this end, the Mo content is preferably 0.01% or more. On the other hand, an excessively high Mo content results in an increased number of inclusions and low ductility and stretch-flangeability. Thus, the Mo content preferably ranges from 0.01% to 0.50%.

B improves hardenability, facilitates the formation of a hard phase, and contributes to high strengthening. To achieve this effect, the B content is preferably 0.0001% or more, more preferably 0.0003% or more. A B content of more than 0.0050% results in excessive formation of martensite and low ductility. Thus, the B content is preferably 0.0050% or less.

Cr is an element that causes solid-solution strengthening, promotes the formation of a hard phase, and contributes to high strengthening. To achieve this effect, the Cr content is preferably 0.01% or more, more preferably 0.03% or more. A Cr content of more than 0.50% results in excessive formation of martensite. Thus, the Cr content is preferably 0.50% or less.

At least one selected from the group consisting of Ti: 0.001% to 0.100%, Nb: 0.001% to 0.050%, and V: 0.001% to 0.100%

Ti binds to C and N, which cause aging degradation, and forms fine carbonitride, and contributes to high strength. To achieve this effect, the Ti content is preferably 0.001% or more, more preferably 0.005% or more. On the other hand, a Ti content of more than 0.100% results in the formation of an excessive number of inclusions, such as carbonitride, and low ductility and stretch-flangeability. Thus, the Ti content is preferably 0.100% or less.

Nb binds to C and N, which cause aging degradation, and forms fine carbonitride, and contributes to high strength. To achieve this effect, the Nb content is preferably 0.001% or more. On the other hand, a Nb content of more than 0.050% results in the formation of an excessive number of inclusions, such as carbonitride, and low ductility and stretch-flangeability. Thus, the Nb content is preferably 0.050% or less.

V binds to C and N, which cause aging degradation, and forms fine carbonitride, and contributes to high strength. To achieve this effect, the V content is preferably 0.001% or more. On the other hand, a V content of more than 0.100% results in the formation of an excessive number of inclusions, such as carbonitride, and low ductility and stretch-flangeability. Thus, the V content is preferably 0.100% or less.

At least one selected from the group consisting of Cu: 0.01% to 1.00%, Ni: 0.01% to 0.50%, As: 0.001% to 0.500%, Sb: 0.001% to 0.100%, Sn: 0.001% to 0.100%, Ta: 0.001% to 0.100%, Ca: 0.0001% to 0.0100%, Mg: 0.0001% to 0.0200%, Zn: 0.001% to 0.020%, Co: 0.001% to 0.020%, Zr: 0.001% to 0.020%, and REM: 0.0001% to 0.0200%

Cu is an element that causes solid-solution strengthening, promotes the formation of a hard phase, and contributes to high strengthening. To achieve this effect, the Cu content is preferably 0.01% or more. A Cu content of more than 1.00% results in excessive formation of martensite and low ductility. Thus, the Cu content is preferably 1.00% or less.

Ni is an element that causes solid-solution strengthening, improves hardenability, promotes the formation of a hard phase, and contributes to high strengthening. To achieve this effect, the Ni content is preferably 0.01% or more. A Ni content of more than 0.50% results in low ductility due to a surface or internal defect caused by an increased number of inclusions. Thus, the Ni content is preferably 0.50% or less.

As is an element that contributes to improved corrosion resistance. To achieve this effect, the As content is preferably 0.001% or more. An As content of more than 0.500% results in low ductility due to a surface or internal defect caused by an increased number of inclusions. Thus, the As content is preferably 0.500% or less.

Sb is an element that concentrates on the surface of a steel sheet, suppresses decarbonization due to nitriding or oxidation of the surface of the steel sheet, reduces the decrease in the C content on the surface layer, promotes the formation of a hard phase, and contributes to high strengthening. To achieve this effect, the Sb content is preferably 0.001% or more. An Sb content of more than 0.100% results in low toughness and ductility due to segregation in steel. Thus, the Sb content is preferably 0.100% or less.

Sn is an element that concentrates on the surface of a steel sheet, suppresses decarbonization due to nitriding or oxidation of the surface of the steel sheet, reduces the decrease in the C content on the surface layer, promotes the formation of a hard phase, and contributes to high strengthening. To achieve this effect, the Sn content is preferably 0.001% or more. A Sn content of more than 0.100% results in low toughness and ductility due to segregation in steel. Thus, the Sn content is preferably 0.100% or less.

Like Ti or Nb, Ta binds to C and N and forms fine carbonitride, and contributes to high strength. Furthermore, Ta dissolves partly in Nb carbonitride, suppresses coarsening of precipitates, and contributes to improved local ductility. To achieve these effects, the Ta content is preferably 0.001% or more. On the other hand, a Ta content of more than 0.100% results in the formation of an excessive number of inclusions, such as carbonitride, an increased number of defects on the surface and in the interior of a steel sheet, and low ductility and stretch-flangeability. Thus, the Ta content is preferably 0.100% or less.

Ca contributes to high local ductility due to spheroidizing of sulfide. To achieve this effect, the Ca content is preferably 0.0001% or more, preferably 0.0003% or more. On the other hand, a Ca content of more than 0.0100% results in low ductility due to an increased number of surface and internal defects caused by an increased number of inclusions, such as sulfide. Thus, the Ca content is preferably 0.0100% or less.

Mg contributes to improved ductility and stretch-flangeability due to spheroidizing of sulfide. To achieve this effect, the Mg content is preferably 0.0001% or more. On the other hand, a Mg content of more than 0.0200% results in low ductility due to an increased number of defects on the surface and in the interior of a steel sheet caused by an increased number of inclusions, such as sulfide. Thus, the Mg content is preferably 0.0200% or less.

Zn contributes to improved ductility and stretch-flangeability due to spheroidizing of sulfide. To achieve this effect, the Zn content is preferably 0.001% or more. On the other hand, a Zn content of more than 0.020% results in low ductility due to an increased number of defects on the surface and in the interior of a steel sheet caused by an increased number of inclusions, such as sulfide. Thus, the Zn content is preferably 0.020% or less.

Co contributes to improved ductility and stretch-flangeability due to spheroidizing of sulfide. To achieve this effect, the Co content is preferably 0.001% or more. On the other hand, a Co content of more than 0.020% results in low ductility due to an increased number of defects on the surface and in the interior of a steel sheet caused by an increased number of inclusions, such as sulfide. Thus, the Co content is preferably 0.020% or less.

Zr contributes to improved ductility and stretch-flangeability due to spheroidizing of sulfide. To achieve this effect, the Zr content is preferably 0.001% or more. On the other hand, a Zr content of more than 0.020% results in low ductility due to an increased number of defects on the surface and in the interior of a steel sheet caused by an increased number of inclusions, such as sulfide. Thus, the Zr content is preferably 0.020% or less.

REM contributes to improved ductility and stretch-flangeability due to spheroidizing of sulfide. To achieve this effect, the REM content is preferably 0.0001% or more. On the other hand, a REM content of more than 0.0200% results in low ductility due to an increased number of defects on the surface and in the interior of a steel sheet caused by an increased number of inclusions, such as sulfide. Thus, the REM content is preferably 0.0200% or less.

The remainder is composed of Fe and incidental impurities.

The steel microstructure of a high-strength cold-rolled steel sheet according to the disclosed embodiments is described below.

A high-strength cold-rolled steel sheet according to the disclosed embodiments has a steel microstructure containing 50% to 80% by area of ferrite, 8% or less by area of martensite with an average grain size of 2.5 μm or less, 6% to 15% by area of retained austenite, and 3% to 40% by area of tempered martensite, the ratio $f_M/f_{M+TM}$ being 50% or less, wherein $f_M$ denotes the area fraction of martensite and $f_{M+TM}$ denotes the total area fraction of martensite and tempered martensite, and the standard deviation of the grain size of martensite at five portions being 0.7 μm or less, the five portions being a width central portion at the center in the sheet width direction, end portions 50 mm inside each end in the sheet width direction, and middle portions between the width central portion and the end portions.

Tempered martensite refers to a bulk microstructure formed in second soaking by tempering of martensite formed at the cooling stop temperature during continuous annealing and a bulk microstructure formed during cooling by tempering of martensite formed in a high-temperature region during a cooling process after second soaking. In tempered martensite, carbide is precipitated in a fine ferrite matrix with a high-density lattice defect, such as dislocation. Thus, tempered martensite has a similar microstructure to bainite transformation. In the disclosed embodiments, therefore, bainite is not distinguished from tempered martensite and is also simply defined as tempered martensite.

Ferrite refers to untransformed ferrite during annealing, ferrite formed at a temperature in the range of 500° C. to 800° C. during cooling after annealing, and bainitic ferrite formed by bainite transformation during second soaking.

Ferrite: 50% to 80% by area

A ferrite fraction (area fraction) of less than 50% results in low elongation due to a decreased amount of soft ferrite. Thus, the ferrite fraction is 50% or more, preferably 55% or more. On the other hand, a ferrite fraction of more than 80% results in high hardness of a hard phase, an increased difference in hardness from soft ferrite of the parent phase, and low stretch-flangeability. Thus, the ferrite fraction is 80% or less, preferably 75% or less.

Martensite: 8% or less by area, average grain size of 2.5 μm or less

To ensure high stretch-flangeability, it is necessary to decrease the difference in hardness between a soft ferrite parent phase and a hard phase. Hard martensite occupying most of the hard phase increases the difference in hardness between the soft ferrite parent phase and the hard phase. Thus, the martensite fraction (area fraction) should be 8% or less. Thus, the martensite fraction is 8% or less, preferably 6% or less. The lower limit of the martensite fraction is not particularly limited and is often 1% or more.

Martensite with an average grain size of more than 2.5 μm tends to become a crack starting point in a punched hole expanding process and decreases stretch-flangeability. Thus, martensite crystals have an average grain size of 2.5 μm or less, preferably 2.0 μm or less. The average grain size has no particular lower limit but is preferably minimized. Since an excessively small grain size requires much time and effort, however, the lower limit is preferably 0.1 μm or more to save time and effort.

Retained austenite: 6% to 15% by area

A retained austenite fraction (area fraction) of less than 6% results in low elongation. To ensure high elongation, the retained austenite fraction is 6% or more, preferably 8% or more. On the other hand, a retained austenite fraction of more than 15% results in an increased amount of retained austenite that undergoes martensitic transformation during a stamping process, an increased number of crack starting points in a hole expanding test, and low stretch-flangeability. Thus, the retained austenite fraction is 15% or less, preferably 13% or less.

Tempered martensite: 3% to 40% by area

To ensure high stretch-flangeability, it is necessary to decrease the hard martensite fraction (area fraction) and contain at least a certain amount of tempered martensite relative to martensite. Thus, the area fraction of tempered martensite is 3% or more, preferably 6% or more. On the other hand, an area fraction of tempered martensite of more than 40% results in low retained austenite and ferrite fractions and low ductility. Thus, the tempered martensite fraction is 40% or less, preferably 35% or less.

The ratio $f_M/f_{M+TM}$ is 50% or less, wherein $f_M$ denotes the area fraction of martensite and $f_{M+TM}$ denotes the total area fraction of martensite and tempered martensite.

To ensure both high strength and high ductility and stretch-flangeability, it is necessary to control the amount of martensite and tempered martensite in the steel microstructure of a steel sheet. When the ratio $f_M/f_{M+TM}$ of the area fraction $f_M$ of martensite to the total area fraction $f_{M+TM}$ of martensite and tempered martensite is more than 50%, this results in an excessively high martensite fraction and low stretch-flangeability. Thus, the ratio is 50% or less, preferably 45% or less, more preferably 40% or less. In the disclosed embodiments, the ratio is very closely related to stretch-flangeability. The lower limit of the ratio $f_M/f_{M+TM}$ is not particularly limited and is often 5% or more.

The standard deviation of the grain size of martensite at five portions is 0.7 μm or less, the five portions being a width central portion, end portions 50 mm inside each end in the sheet width direction, and middle portions between the width central portion and the end portions.

Variations in the grain size of martensite have an influence on the in-plane stability of stretch-flangeability and are therefore important in the disclosed embodiments. When the standard deviation of the grain size of martensite at the five portions, that is, the width central portion at the center in the sheet width direction, the end portions 50 mm inside each end in the sheet width direction, and the middle portions between the width central portion and the end portions is more than 0.7 μm, this results in large in-plane variations in stretch-flangeability. Thus, the standard deviation of the grain size of martensite is 0.7 μm or less, preferably 0.6 μm or less, more preferably 0.5 μm or less. The lower limit of the standard deviation is not particularly limited and is often 0.2 μm or more.

A high-strength cold-rolled steel sheet according to the disclosed embodiments may have any thickness and preferably has a standard sheet thickness in the range of 0.8 to 2.0 mm.

A high-strength cold-rolled steel sheet according to the disclosed embodiments may be used as a high-strength coated steel sheet including a coated layer formed on the high-strength cold-rolled steel sheet. The coated layer may be of any type. The coated layer may be a hot-dip coated layer (for example, a hot-dip galvanized layer) or an alloyed hot-dip coated layer (for example, an alloyed hot-dip galvanized layer).

A method for producing a high-strength cold-rolled steel sheet according to the disclosed embodiments is described below. A production method according to the disclosed embodiments includes a hot rolling step, a cold rolling step, a first soaking step, and a second soaking step. If necessary, the second soaking step is followed by a coating step. If necessary, the coating step is followed by an alloying step of performing alloying treatment. The temperature in the following description refers to the surface temperature of a slab, a steel sheet, or the like.

The hot rolling step includes heating a steel slab with the above composition to a temperature in the range of 1100° C. to 1300° C., hot rolling the steel slab at a finish rolling exit temperature in the range of 800° C. to 950° C., and coiling the hot-rolled sheet at a coiling temperature in the range of 300° C. to 700° C. and at a difference of 70° C. or less in coiling temperature in the temperature distribution in the sheet width direction.

In the disclosed embodiments, a steel slab with the above composition is used as a material. The steel slab may be any steel slab produced by any method. For example, the steel slab can be produced by casting molten steel with the above composition by routine procedures. A melting process may be performed by any method, for example, with a converter or an electric furnace. To prevent macrosegregation, the steel slab is preferably produced by a continuous casting process but may also be produced by an ingot casting process or a thin slab casting process.

Steel slab heating temperature: 1100° C. to 1300° C.

Before hot rolling, the steel slab is heated to the steel slab heating temperature. Ti and Nb precipitates finely distributed in the microstructure are effective in suppressing recrystallization during heating in an annealing process and making the microstructure finer. Precipitates in a steel slab heating step, however, remain as coarse precipitates in the final steel sheet, make a phase constituting the microstructure generally coarse, and decrease stretch-flangeability. Thus, Ti and Nb precipitates after casting must be redissolved by heating. At a steel slab heating temperature of less than 1100° C., precipitates cannot be sufficiently dissolved in the steel. On the other hand, a steel slab heating temperature of more than 1300° C. results in an increased scale loss due to an increased amount of oxidation. Thus, the steel slab heating temperature ranges from 1100° C. to 1300° C.

In the heating step, after the steel slab is produced, the steel slab may be cooled to room temperature and subsequently reheated by a known method. Alternatively, without cooling to room temperature, the steel slab may be subjected without problems to an energy-saving process, such as hot direct rolling or direct rolling, in which the hot slab is conveyed directly into a furnace or is immediately rolled after short thermal insulation.

Finish rolling exit temperature: 800° C. to 950° C.

The heated steel slab is then hot-rolled to form a hot-rolled steel sheet. In this hot-rolling step, to improve elongation and stretch-flangeability after annealing by making the microstructure of the steel sheet uniform and decreasing the anisotropy of the material quality, the hot rolling must be completed in the austenite single phase region. Thus, the finish rolling exit temperature is 800° C. or more. On the other hand, a finishing temperature of more than 950° C. results in a large grain size of the hot rolling microstructure and low strength and ductility after annealing. Thus, the finish rolling exit temperature is 950° C. or less.

The hot rolling may be composed of rough rolling and finish rolling in accordance with routine procedures. The steel slab is formed into a sheet bar by rough rolling. To avoid troubles during hot rolling, for example, at a low heating temperature, the sheet bar is preferably heated with a bar heater before finish rolling.

Coiling temperature: 300° C. to 700° C.

The hot-rolled steel sheet produced in the hot-rolling step is then coiled. A coiling temperature of more than 700° C. results in a large ferrite grain size of the steel microstructure of the hot-rolled steel sheet, making it difficult to ensure the desired strength after annealing. Thus, the coiling temperature is 700° C. or less. On the other hand, a coiling temperature of less than 300° C. results in increased strength of the hot-rolled steel sheet, an increased rolling load in the subsequent cold rolling step, and low productivity. Cold rolling of a hard hot-rolled steel sheet composed mainly of martensite tends to cause a fine internal crack (brittle crack) in the martensite along the prior austenite grain boundary, resulting in low ductility and stretch-flangeability of the annealed sheet. Thus, the coiling temperature is 300° C. or more.

Difference of 70° C. or less in coiling temperature in temperature distribution in sheet width direction A difference of more than 70° C. in coiling temperature in the temperature distribution in the sheet width direction results in an increased amount of martensite in the hot rolling microstructure in a portion with a low coiling temperature, thus increasing variations in the grain size of martensite after annealing. Thus, the difference in coiling temperature in the temperature distribution in the sheet width direction is 70° C. or less, preferably 60° C. or less, more preferably 50° C. or less. The temperature distribution in the sheet width direction can be determined with a scanning radiation thermometer. The term "difference in coiling temperature" refers to the difference between the maximum value and the minimum value in the temperature distribution. The temperature distribution in the sheet width direction may be controlled with an edge heater, for example. The difference in coiling temperature in the temperature distribution in the sheet width direction is preferably minimized. Considering controllability as well as the resulting effects, the difference in coiling temperature is preferably 15° C. or more.

The cold rolling step refers to the step of cold rolling at a rolling reduction of 30% or more after the hot rolling step.

Descaling (Suitable Conditions)

The hot-rolled steel sheet after the coiling is uncoiled and is subjected to cold rolling preferably after descaling. The cold rolling is described later. Descaling can remove scales from the steel sheet surface layer. Descaling may be performed by any method, such as pickling or grinding, preferably by pickling. The pickling conditions are not particularly limited and may be in accordance with routine procedures.

Cold rolling at rolling reduction of 30% or more

The hot-rolled steel sheet is cold-rolled to form a cold-rolled steel sheet with a predetermined thickness. A rolling reduction of less than 30% results in a difference in strain between the surface layer and the interior, variations in the number of grain boundaries or dislocations serving as nuclei for reverse transformation to austenite during annealing in the next step, and consequently uneven grain sizes of martensite. Thus, the rolling reduction in the cold rolling is 30% or more, preferably 40% or more. The upper limit of the rolling reduction in the cold rolling is not particularly limited and is preferably 80% or less in terms of the sheet shape stability.

The first soaking step after the cold rolling step is the step of heating the cold-rolled steel sheet to a first soaking temperature in the range of T1 to T2, and cooling the cold-rolled steel sheet at an average cooling rate to 500° C. of 10° C./s or more to a cooling stop temperature in the range of (Ms—100° C.) to Ms, wherein Ms denotes the martensitic transformation start temperature (hereinafter referred to simply as Ms), the difference in cooling stop temperature in the temperature distribution in the sheet width direction during the cooling being 30° C. or less.

Soaking temperature: temperature T1 to T2

The temperature T1 represented by the following formula refers to the transformation start temperature from ferrite to austenite. The temperature T2 refers to the temperature at which the steel microstructure becomes an austenite single phase. At a soaking temperature below the temperature T1, a hard phase required for high strength cannot be formed. On the other hand, at a soaking temperature above the temperature T2, ferrite required for high ductility is not formed. Thus, the first soaking conditions include the soaking temperature in the range of T1 to T2, and ferrite-austenite two-phase annealing is performed.

The temperatures T1 and T2 and Ms are represented by the following formulae.

$$\text{Temperature } T1(^\circ\text{ C.})=751-27\times[\%\text{ C}]+18\times[\%\text{ Si}]-12\times[\%\text{ Mn}]-169\times[\%\text{ Al}]-6\times[\%\text{ Ti}]+24\times[\%\text{ Cr}]-895\times[\%\text{ B}]$$

$$\text{Temperature } T2(^\circ\text{ C.})=937-477\times[\%\text{ C}]+56\times[\%\text{ Si}]-20\times[\%\text{ Mn}]+198\times[\%\text{ Al}]+136\times[\%\text{ Ti}]-5\times[\%\text{ Cr}]+3315\times[\%\text{ B}]$$

$$\text{Ms } (^\circ\text{ C.})=539-423\times\{[\%\text{ C}]/(1-[\%\ \alpha]/100)\}-30\times[\%\text{ Mn}]-12\times[\%\text{ Cr}]-18\times[\%\text{ Ni}]-8\times[\%\text{ Mo}]$$

[% X] in the formulae denotes the component element X content (% by mass) of the steel sheet, and [% α] denotes the ferrite fraction at Ms during cooling. The formula of Ms is based on the Andrews equation (K. W. Andrews: J. Iron Steel Inst., 203 (1965), 721.). The ferrite fraction at Ms during cooling can be determined by the Formaster test.

Cooling conditions after first soaking: average cooling rate to 500° C. of 10° C./s or more The average cooling rate refers to the average cooling rate from the first soaking temperature to 500° C. The average cooling rate is calculated by dividing the temperature difference between the first soaking temperature and 500° C. by the cooling time from the first soaking temperature to 500° C.

A predetermined fraction of tempered martensite is necessary to ensure stretch-flangeability. Cooling to the martensitic transformation start temperature or lower in the cooling after the first soaking is necessary to form tempered martensite in the second soaking step described later. An average cooling rate of less than 10° C./s from the first soaking temperature to 500° C., however, results in low strength due to excessive formation of ferrite during cooling. Thus, under the cooling conditions after the first soaking, the average cooling rate to 500° C. has a lower limit of 10° C./s or more. On the other hand, the average cooling rate to 500° C. has no particular upper limit and is preferably 100° C./s or less to form a certain amount of ferrite, which contributes to high ductility.

Cooling stop temperature: (Ms—100° C.) to Ms

A cooling stop temperature below (Ms—100° C.), wherein Ms denotes the martensitic transformation start temperature, results in an increased amount of martensite formed at the cooling stop temperature, a decreased amount of untransformed austenite, a decreased amount of retained austenite in the microstructure after annealing, and low ductility. Thus, the cooling stop temperature has a lower limit of (Ms—100° C.). On the other hand, a cooling stop temperature above Ms results in the absence of martensite at the cooling stop temperature, an amount of tempered martensite smaller than the defined amount of the disclosed embodiments, and low stretch-flangeability. Thus, the cooling stop temperature has an upper limit of Ms. Thus, the cooling stop temperature ranges from (Ms—100° C.) to Ms, preferably (Ms—90° C.) to (Ms—10° C.). The cooling stop temperature ranges typically from 100° C. to 350° C.

Difference of 30° C. or less in cooling stop temperature in temperature distribution in sheet width direction A difference of more than 30° C. in cooling stop temperature in the temperature distribution in the sheet width direction results in an increased amount of tempered martensite in the microstructure after annealing in a portion with a lower cooling stop temperature and a large difference in the hole expanding ratio (λ) in the sheet width direction. Thus, the difference in cooling stop temperature in the temperature distribution in the sheet width direction is 30° C. or less, preferably 25° C. or less, more preferably 20° C. or less. The temperature distribution in the sheet width direction can be determined with a scanning radiation thermometer. The term "difference in cooling stop temperature" refers to the difference between the maximum value and the minimum value in the temperature distribution. The temperature distribution in the sheet width direction may be controlled with an edge heater, for example. The difference in cooling stop temperature in the temperature distribution in the sheet width direction is preferably minimized. Considering controllability as well as the resulting effects, the difference in coiling temperature is preferably 2° C. or more.

The second soaking step after the first soaking step is the step of reheating the steel sheet to a second soaking temperature in the range of 350° C. to 500° C., soaking the steel sheet for 10 seconds or more at a difference of 30° C. or less in second soaking temperature in the temperature distribution in the sheet width direction during the reheating, and cooling the steel sheet to room temperature.

Soaking temperature: 350° C. to 500° C., holding (soaking) time: 10 seconds or more In order to temper martensite formed in the middle of cooling to form tempered martensite and in order for bainite transformation of untransformed austenite to form retained austenite in the steel microstructure, the steel sheet after cooling in the first soaking step is reheated and held at a temperature in the range of 350° C. to 500° C. for 10 seconds or more in the second soaking. A soaking temperature of less than 350° C. in the second soaking results in insufficient tempering of martensite, a large difference in hardness from ferrite and martensite, and low stretch-flangeability. On the other hand, a soaking temperature of more than 500° C. results in excessive formation of pearlite and low strength. Thus, the soaking temperature ranges from 350° C. to 500° C.

A holding (soaking) time of less than 10 seconds results in insufficient bainite transformation, more remaining untransformed austenite, finally excessive formation of martensite, and low stretch-flangeability. Thus, the holding (soaking) time has a lower limit of 10 seconds. The holding (soaking) time has no particular upper limit. A holding (soaking) time of more than 1500 seconds, however, does not have an influence on the steel sheet structure or mechanical properties. Thus, the holding (soaking) time is preferably 1500 seconds or less.

Difference of 30° C. or less in second soaking temperature in temperature distribution in sheet width direction A difference of more than 30° C. in second soaking temperature in the temperature distribution in the sheet width direction results in a difference in the degree of bainite transformation in the sheet width direction, a difference in the amount of retained γ, and a large difference in ductility and stretch-flangeability in the sheet width direction. Thus, the difference in second soaking temperature in the temperature distribution in the sheet width direction is 30° C. or less, preferably 25° C. or less, more preferably 20° C. or less. The temperature distribution in the sheet width direction can be determined with a scanning radiation thermometer. The term "difference in second soaking temperature" refers to the difference between the maximum value and the minimum value in the temperature distribution. The temperature distribution in the sheet width direction may be controlled with an edge heater, for example. The difference in second soaking temperature in the temperature distribution in the sheet width direction is preferably minimized. Considering controllability as well as the resulting effects, the temperature difference is preferably 2° C. or more.

The second soaking step may be followed by the coating step of coating treatment on the surface. As described above, the coated layer may be of any type in the disclosed embodiments. Thus, the coating treatment may also be of any type. For example, the coating treatment may be hot-dip galvanizing or alloying after the hot-dip galvanizing.

EXAMPLES

A steel with a composition listed in Table 1 (the remainder component: Fe and incidental impurities) was melted and formed into a steel slab by a continuous casting process. The slab was heated under the conditions listed in Tables 2 to 4, was subjected to rough rolling and finish rolling, was cooled, and was coiled with the coiling temperature being strictly controlled in the width direction, thereby forming a hot-rolled steel sheet. The hot-rolled steel sheet was descaled and cold-rolled into a cold-rolled steel sheet. The cold-rolled steel sheet had a thickness in the range of 1.2 to 1.6 mm. Subsequently, the cold-rolled steel sheet was heated and annealed at a soaking temperature (first soaking temperature) listed in Tables 2 to 4, and was cooled to 500° C. at a strictly controlled cooling rate and at an average cooling rate listed in Tables 2 to 4. The cooling was stopped at a cooling stop temperature listed in Tables 2 to 4 with the cooling stop temperature distribution in the width direction being strictly controlled. Subsequently, the cold-rolled steel sheet was immediately heated and soaked at a second soaking temperature for a second holding time listed in Tables 2 to 4 with the second soaking temperature distribution in the width direction being strictly controlled, and was cooled to room temperature. Some high-strength cold-rolled steel sheets (CR) were subjected to coating treatment. For hot-dip galvanized steel sheets (GI), a zinc bath containing 0.19% by mass of Al was used as a hot-dip galvanizing bath. For galvannealed steel sheets (GA), a zinc bath containing 0.14% by mass of Al was used. The bath temperature was 465° C. in both cases. The alloying temperature for GA was 550° C. The amount of coating was 45 g/m$^2$ per side (double-sided coating). For GA, the concentration of Fe in the coated layer ranged from 9% to 12% by mass.

Tables 5 to 7 list the measurements of the steel microstructure, yield strength, tensile strength, elongation, and hole expanding ratio of each steel sheet.

In the tensile test, a JIS No. 5 tensile test specimen (gauge length: 50 mm, width: 25 mm) was taken from the width central portion of the annealed coil in the C direction (perpendicular to the rolling direction) of the steel sheet. The yield stress (YS), tensile strength (TS), and total elongation (El) were measured at a crosshead speed of 10 mm/min in accordance with JIS Z 2241 (2011).

The stretch-flangeability was measured in a hole expanding test in accordance with JIS Z 2256 (2010). Three test specimens 100 mm square were taken from the width central portion of the annealed coil and were punched with a punch 10 mm in diameter and a die at a clearance of 12.5%. The hole expanding ratio (λ) was measured with a conical punch with a vertex angle of 60 degrees at a movement speed of 10 mm/min with a burred surface facing upward. The average hole expanding ratio was evaluated. The equation is described below.

$$\text{Hole expanding ratio } \lambda(\%)=\{(D-D_0)/D_0\}\times 100$$

D: the hole diameter when a crack passes through the sheet, $D_0$: initial hole diameter (10 mm)

For the in-plane stability of stretch-flangeability, three test specimens 100 mm square were taken from each of both end portions and the width central portion of the annealed coil. The hole expanding test was performed in the same manner as described above. The standard deviation of nine hole expanding ratios (k) was evaluated.

To observe the steel microstructure, a cross section in the L direction (a cross section in the rolling direction) was mirror-polished with an alumina buff and was then subjected to nital etching. A portion at a quarter thickness was observed with an optical microscope and a scanning electron microscope (SEM). To more closely observe the internal microstructure of the hard phase, a secondary electron image was observed with an in-Lens detector at a low accelerating voltage of 1 kV. An L cross section of the specimen was mirror-polished with a diamond paste, was then final-polished with colloidal silica, and was etched with 3% by volume nital. The reason for observation at a low accelerating voltage is that small asperities of a fine microstructure on the surface of the specimen formed by a low concentration of nital can be clearly captured. Each microstructure was observed in five 18 μm×24 μm regions. The area fractions of constituent phases in the five regions in the microstructure images were determined by particle analysis ver. 3 available from Nippon Steel & Sumikin Technology and were averaged. In the disclosed embodiments, the ratio of the area of each microstructure to the observation area was considered to be the area fraction of the microstructure. In the microstructure image data, ferrite, which is black, can be distinguished from tempered martensite containing differently orientated fine carbide, which is light gray. In the microstructure image data, retained austenite and martensite appear white. The area fraction of the microstructure of retained austenite was determined by X-ray diffractometry described later. The area fraction of the microstructure of martensite was calculated by subtracting the area fraction of retained austenite determined by X-ray diffractometry from the total of martensite and retained austenite in the microstructure image. The position at which the area fractions of ferrite, martensite, retained austenite, and tempered martensite were measured was the central portion in the width direction.

The area fraction of retained austenite was measured as described below. The volume fraction of retained austenite was determined by grinding a steel sheet by one fourth the thickness of the steel sheet, chemically polishing the surface by 0.1 mm, measuring the integrated reflection intensities of the (200), (220), and (311) planes of fcc iron (austenite) and the (200), (211), and (220) planes of bcc iron (ferrite) with an X-ray diffractometer using Mo Kα radiation, and calculating the proportion of austenite from the intensity ratio of the integrated reflection intensities of the planes of the fcc iron (austenite) to the integrated reflection intensities of the planes of the bcc iron (ferrite). The volume fraction of retained austenite was determined at randomly selected three points in the middle position of a high-strength steel sheet in the width direction. The average value of the volume fractions was considered to be the area fraction of retained austenite.

The grain size of martensite in the disclosed embodiments was determined in martensite observed by SEM-EBSD (electron back-scatter diffraction). A cross section (an L cross section) in the thickness direction parallel to the rolling direction of the steel sheet was polished in the same manner as in the SEM observation and was etched with 0.1% by volume nital. The microstructure of a portion at a quarter thickness of the cross section was analyzed. The average grain size was determined from the data by AMETEKEDAX OIM Analysis. The grain size was the average length in the rolling direction (L direction) and in a direction perpendicular to the rolling direction (C direction). The microstructure was observed at five portions: a width central portion, end portions 50 mm inside each end, and middle portions between the width central portion and the end portions. The standard deviation of the grain size of martensite was calculated from the measured grain sizes of martensite.

In the above evaluation, TS of 780 MPa or more was considered to be high strength, TS x El of 20000 MPa·% or more was considered to be high ductility, TS x hole expanding ratio (λ) of 30000 MPa·% or more was considered to be high stretch-flangeability, and a standard deviation of hole expanding ratio (λ) of 4% or less was considered to be high in-plane stability of stretch-flangeability.

Tables 5 to 7 show that the working examples (conforming steels) have high strength, high ductility and stretch-flangeability, and high in-plane stability of stretch-flangeability. By contrast, the comparative examples (comparative steels) were inferior in at least one of strength, ductility, stretch-flangeability, and in-plane stability of stretch-flangeability.

Although the disclosed embodiments were described, the disclosure is not intended to be limited to these specific embodiments. The other embodiments, examples, and operational techniques made by a person skilled in the art on the basis of the disclosed embodiments are all within the scope of the disclosure. For example, in a series of heat treatments in the production method, equipment for heat treatment of a steel sheet is not particularly limited, provided that the thermal history conditions are satisfied.

TABLE 1

| Steel | Composition (mass %) | | | | | | | | Temperature T1 | Temperature T2 | |
|---|---|---|---|---|---|---|---|---|---|---|---|
| type | C | Si | Mn | P | S | Al | N | Others | (° C.) | (° C.) | Note |
| 1 | 0.052 | 1.32 | 2.76 | 0.012 | 0.0021 | 0.029 | 0.0055 | — | 735 | 937 | Comparative steel |
| 2 | 0.065 | 1.13 | 2.71 | 0.018 | 0.0008 | 0.046 | 0.0040 | — | 729 | 924 | Conforming steel |

TABLE 1-continued

| Steel type | Composition (mass %) C | Si | Mn | P | S | Al | N | Others | Temperature T1 (° C.) | Temperature T2 (° C.) | Note |
|---|---|---|---|---|---|---|---|---|---|---|---|
| 3 | 0.074 | 1.28 | 2.65 | 0.005 | 0.0018 | 0.033 | 0.0057 | — | 735 | 927 | Conforming steel |
| 4 | 0.083 | 1.13 | 2.51 | 0.015 | 0.0016 | 0.042 | 0.0040 | — | 732 | 919 | Conforming steel |
| 5 | 0.191 | 1.12 | 1.53 | 0.005 | 0.0019 | 0.036 | 0.0041 | — | 742 | 885 | Conforming steel |
| 6 | 0.212 | 1.28 | 1.40 | 0.016 | 0.0020 | 0.040 | 0.0041 | — | 745 | 887 | Conforming steel |
| 7 | 0.243 | 1.24 | 1.22 | 0.016 | 0.0014 | 0.039 | 0.0043 | — | 746 | 874 | Conforming steel |
| 8 | 0.264 | 0.91 | 1.02 | 0.017 | 0.0015 | 0.049 | 0.0056 | — | 740 | 851 | Comparative steel |
| 9 | 0.198 | 0.42 | 2.23 | 0.015 | 0.0010 | 0.030 | 0.0036 | — | 721 | 827 | Comparative steel |
| 10 | 0.189 | 0.58 | 2.14 | 0.009 | 0.0011 | 0.044 | 0.0040 | — | 723 | 845 | Conforming steel |
| 11 | 0.182 | 0.83 | 2.07 | 0.010 | 0.0021 | 0.032 | 0.0050 | — | 731 | 862 | Conforming steel |
| 12 | 0.173 | 1.13 | 1.98 | 0.013 | 0.0012 | 0.029 | 0.0025 | — | 738 | 884 | Conforming steel |
| 13 | 0.160 | 1.41 | 1.85 | 0.008 | 0.0010 | 0.042 | 0.0050 | — | 743 | 911 | Conforming steel |
| 14 | 0.154 | 1.55 | 1.79 | 0.010 | 0.0013 | 0.041 | 0.0038 | — | 746 | 923 | Conforming steel |
| 15 | 0.146 | 1.70 | 1.71 | 0.008 | 0.0011 | 0.039 | 0.0035 | — | 751 | 936 | Conforming steel |
| 16 | 0.112 | 1.89 | 1.95 | 0.009 | 0.0018 | 0.049 | 0.0034 | — | 750 | 960 | Comparative steel |
| 17 | 0.210 | 0.89 | 0.92 | 0.017 | 0.0011 | 0.025 | 0.0050 | — | 746 | 873 | Comparative steel |
| 18 | 0.068 | 1.01 | 2.92 | 0.011 | 0.0012 | 0.038 | 0.0057 | — | 726 | 910 | Comparative steel |
| 19 | 0.172 | 1.18 | 2.02 | 0.008 | 0.0018 | 0.014 | 0.0057 | — | 741 | 883 | Conforming steel |
| 20 | 0.173 | 1.22 | 1.95 | 0.012 | 0.0020 | 0.063 | 0.0047 | — | 734 | 896 | Conforming steel |
| 21 | 0.165 | 1.19 | 2.03 | 0.006 | 0.0016 | 0.085 | 0.0041 | — | 729 | 901 | Conforming steel |
| 22 | 0.180 | 1.17 | 2.02 | 0.017 | 0.0018 | 0.111 | 0.0052 | — | 724 | 898 | Comparative steel |
| 23 | 0.161 | 1.18 | 1.99 | 0.008 | 0.0019 | 0.038 | 0.0049 | Mo: 0.38 | 738 | 894 | Conforming steel |
| 24 | 0.175 | 1.26 | 2.04 | 0.020 | 0.0021 | 0.037 | 0.0025 | Ti: 0.085 | 738 | 902 | Conforming steel |
| 25 | 0.162 | 1.13 | 1.94 | 0.015 | 0.0008 | 0.042 | 0.0028 | Nb: 0.036 | 737 | 893 | Conforming steel |
| 26 | 0.173 | 1.28 | 1.98 | 0.009 | 0.0020 | 0.042 | 0.0043 | V: 0.088 | 739 | 895 | Conforming steel |
| 27 | 0.166 | 1.19 | 1.97 | 0.009 | 0.0010 | 0.030 | 0.0055 | B: 0.0038 | 736 | 904 | Conforming steel |
| 28 | 0.177 | 1.20 | 1.88 | 0.008 | 0.0019 | 0.047 | 0.0054 | Cr: 0.4 | 747 | 889 | Conforming steel |
| 29 | 0.176 | 1.21 | 2.03 | 0.005 | 0.0015 | 0.048 | 0.0033 | Cu: 0.86 | 736 | 890 | Conforming steel |
| 30 | 0.178 | 1.17 | 1.86 | 0.010 | 0.0008 | 0.028 | 0.0053 | Ni: 0.36 | 740 | 886 | Conforming steel |
| 31 | 0.168 | 1.14 | 2.01 | 0.008 | 0.0010 | 0.031 | 0.0035 | As: 0.043 | 738 | 887 | Conforming steel |
| 32 | 0.165 | 1.12 | 1.87 | 0.012 | 0.0017 | 0.039 | 0.0035 | Sb: 0.084 | 738 | 891 | Conforming steel |
| 33 | 0.165 | 1.24 | 2.01 | 0.011 | 0.0010 | 0.028 | 0.0028 | Sn: 0.086 | 740 | 893 | Conforming steel |
| 34 | 0.175 | 1.20 | 2.00 | 0.018 | 0.0011 | 0.050 | 0.0025 | Ta: 0.085 | 735 | 891 | Conforming steel |
| 35 | 0.173 | 1.16 | 2.00 | 0.008 | 0.0017 | 0.042 | 0.0040 | Ca: 0.0086 | 736 | 888 | Conforming steel |
| 36 | 0.180 | 1.28 | 1.95 | 0.010 | 0.0017 | 0.025 | 0.0056 | Mg: 0.0188 | 742 | 889 | Conforming steel |
| 37 | 0.160 | 1.25 | 2.01 | 0.008 | 0.0010 | 0.041 | 0.0054 | Zn: 0.008 | 738 | 899 | Conforming steel |
| 38 | 0.179 | 1.13 | 1.98 | 0.005 | 0.0021 | 0.038 | 0.0057 | Co: 0.006 | 736 | 883 | Conforming steel |
| 39 | 0.161 | 1.16 | 1.90 | 0.009 | 0.0022 | 0.031 | 0.0038 | Zr: 0.006 | 739 | 893 | Conforming steel |
| 40 | 0.169 | 1.24 | 1.92 | 0.017 | 0.0013 | 0.040 | 0.0038 | REMO.0185 | 739 | 895 | Conforming steel |

TABLE 2

| No. | Steel type | Hot rolling *1 (° C.) | *2 (° C.) | *3 (° C.) | *4 (° C.) | Cold rolling: Rolling reduction (%) | Annealing conditions: First soaking: First soaking temperature (° C.) | *5 (° C./s) | Cooling stop temperature (° C.) | *6 (° C.) | Second soaking: Second soaking temperature (° C.) |
|---|---|---|---|---|---|---|---|---|---|---|---|
| 1 | 1 | 1220 | 870 | 520 | 44 | 58 | 830 | 33 | 330 | 9 | 400 |
| 2 | 2 | 1270 | 880 | 430 | 36 | 51 | 850 | 32 | 310 | 6 | 450 |
| 3 | 3 | 1250 | 890 | 360 | 26 | 63 | 840 | 31 | 310 | 11 | 420 |
| 4 | 4 | 1260 | 850 | 410 | 43 | 49 | 830 | 24 | 300 | 8 | 440 |
| 5 | 5 | 1200 | 820 | 410 | 32 | 57 | 820 | 28 | 210 | 16 | 440 |
| 6 | 6 | 1250 | 910 | 480 | 26 | 64 | 810 | 23 | 180 | 15 | 430 |
| 7 | 7 | 1130 | 890 | 640 | 38 | 61 | 800 | 15 | 160 | 11 | 440 |
| 8 | 8 | 1180 | 860 | 420 | 43 | 61 | 840 | 30 | 100 | 17 | 380 |
| 9 | 9 | 1280 | 900 | 390 | 25 | 63 | 830 | 21 | 180 | 8 | 380 |
| 10 | 10 | 1230 | 930 | 360 | 43 | 52 | 850 | 35 | 170 | 5 | 440 |
| 11 | 11 | 1160 | 870 | 470 | 25 | 70 | 830 | 23 | 170 | 15 | 390 |
| 12 | 12 | 1200 | 850 | 610 | 29 | 57 | 830 | 29 | 210 | 5 | 420 |
| 13 | 5 | 1050 | 840 | 520 | 42 | 51 | 800 | 18 | 210 | 13 | 410 |
| 14 | 11 | 1190 | 760 | 350 | 29 | 53 | 840 | 27 | 180 | 15 | 440 |
| 15 | 12 | 1160 | 990 | 460 | 42 | 50 | 810 | 27 | 120 | 9 | 450 |
| 16 | 13 | 1160 | 840 | 270 | 29 | 55 | 830 | 16 | 290 | 10 | 390 |
| 17 | 19 | 1280 | 870 | 730 | 42 | 69 | 810 | 31 | 100 | 17 | 450 |
| 18 | 5 | 1200 | 890 | 600 | 55 | 43 | 840 | 21 | 190 | 10 | 390 |
| 19 | 11 | 1220 | 870 | 420 | 65 | 47 | 830 | 22 | 210 | 12 | 440 |
| 20 | 13 | 1270 | 820 | 440 | 78 | 45 | 830 | 24 | 270 | 7 | 410 |
| 21 | 12 | 1230 | 830 | 650 | 37 | 22 | 820 | 33 | 240 | 11 | 380 |
| 22 | 19 | 1280 | 840 | 640 | 32 | 33 | 850 | 20 | 240 | 9 | 420 |

TABLE 2-continued

| | | | | | | | | | | | |
|---|---|---|---|---|---|---|---|---|---|---|---|
| 23 | 5 | 1260 | 920 | 600 | 45 | 43 | 700 | 27 | 50 | 15 | 440 |
| 24 | 11 | 1270 | 840 | 530 | 41 | 60 | 950 | 31 | 340 | 8 | 410 |
| 25 | 13 | 1120 | 850 | 560 | 36 | 64 | 830 | 5 | 120 | 6 | 390 |
| 26 | 19 | 1260 | 920 | 470 | 41 | 54 | 800 | 60 | 250 | 16 | 370 |
| 27 | 12 | 1240 | 850 | 570 | 44 | 44 | 820 | 35 | 220 | 13 | 370 |
| 28 | 12 | 1160 | 860 | 640 | 37 | 69 | 820 | 18 | 270 | 14 | 450 |
| 29 | 5 | 1140 | 920 | 450 | 25 | 44 | 810 | 21 | 200 | 26 | 450 |
| 30 | 11 | 1240 | 910 | 610 | 43 | 70 | 850 | 20 | 220 | 32 | 410 |

| | Annealing conditions Second soaking | | | | MS – | | | |
|---|---|---|---|---|---|---|---|---|
| No. | Second holding time (s) | *7 (° C.) | *8 (%) | Ms (° C.) | 100° C. (° C.) | *9 (° C.) | Surface | Note |
| 1 | 210 | 9 | 48 | 414 | 314 | 84 | CR | Comparative steel |
| 2 | 1200 | 6 | 51 | 402 | 302 | 92 | CR | Conforming steel |
| 3 | 750 | 17 | 53 | 393 | 293 | 83 | CR | Conforming steel |
| 4 | 1170 | 9 | 56 | 384 | 284 | 84 | CR | Conforming steel |
| 5 | 620 | 8 | 65 | 262 | 162 | 52 | CR | Conforming steel |
| 6 | 350 | 16 | 68 | 217 | 117 | 37 | CR | Conforming steel |
| 7 | 490 | 5 | 67 | 191 | 91 | 31 | CR | Conforming steel |
| 8 | 270 | 12 | 66 | 180 | 80 | 80 | CR | Comparative steel |
| 9 | 410 | 5 | 66 | 226 | 126 | 46 | CR | Comparative steel |
| 10 | 150 | 16 | 64 | 253 | 153 | 83 | CR | Conforming steel |
| 11 | 430 | 10 | 65 | 257 | 157 | 87 | CR | Conforming steel |
| 12 | 270 | 18 | 65 | 271 | 171 | 61 | CR | Conforming steel |
| 13 | 810 | 18 | 65 | 262 | 162 | 52 | CR | Comparative steel |
| 14 | 1010 | 6 | 68 | 236 | 136 | 56 | CR | Comparative steel |
| 15 | 1020 | 17 | 76 | 175 | 75 | 55 | CR | Comparative steel |
| 16 | 170 | 14 | 51 | 345 | 245 | 55 | CR | Comparative steel |
| 17 | 820 | 11 | 77 | 162 | 62 | 62 | CR | Comparative steel |
| 18 | 320 | 14 | 67 | 248 | 148 | 58 | CR | Conforming steel |
| 19 | 390 | 6 | 64 | 263 | 163 | 53 | CR | Conforming steel |
| 20 | 670 | 17 | 60 | 314 | 214 | 44 | CR | Comparative steel |
| 21 | 1060 | 14 | 61 | 292 | 192 | 52 | CR | Comparative steel |
| 22 | 360 | 15 | 64 | 276 | 176 | 36 | CR | Conforming steel |
| 23 | 400 | 8 | 88 | −180 | −280 | −230 | CR | Comparative steel |
| 24 | 210 | 17 | 18 | 383 | 283 | 43 | CR | Comparative steel |
| 25 | 590 | 17 | 79 | 161 | 61 | 41 | CR | Comparative steel |
| 26 | 610 | 7 | 59 | 301 | 201 | 51 | CR | Conforming steel |
| 27 | 560 | 13 | 50 | 333 | 233 | 113 | CR | Comparative steel |
| 28 | 420 | 12 | 67 | 258 | 158 | −12 | CR | Comparative steel |
| 29 | 980 | 16 | 65 | 262 | 162 | 62 | CR | Conforming steel |
| 30 | 1080 | 11 | 62 | 274 | 174 | 54 | CR | Comparative steel |

*1: Steel slab heating temperature,
*2: Finish rolling exit temperature,
*3: Average coiling temperature,
*4: Difference in coiling temperature in sheet width direction
*5: Average cooling rate to 500° C.,
*6: Difference in cooling stop temperature in sheet width direction,
*7: Difference in second soaking temperature in sheet width direction
*8: Ferrite fraction at Ms during cooling,
*9: Temperature difference between cooling stop temperature and Ms

TABLE 3

| | | | | | | Cold rolling | Annealing conditions | | | | |
|---|---|---|---|---|---|---|---|---|---|---|---|
| | | | | | | | First soaking | | | | Second soaking |
| | | Hot rolling | | | | Rolling | First soaking | | Cooling stop | | Second soaking |
| No. | Steel type | *1 (° C.) | *2 (° C.) | *3 (° C.) | *4 (° C.) | reduction (%) | temperature (° C.) | *5 (° C./s) | temperature (° C.) | *6 (° C.) | temperature (° C.) |
| 31 | 12 | 1120 | 890 | 470 | 40 | 55 | 850 | 26 | 150 | 15 | 330 |
| 32 | 13 | 1220 | 850 | 630 | 38 | 45 | 850 | 22 | 260 | 10 | 550 |
| 33 | 19 | 1160 | 890 | 460 | 37 | 67 | 800 | 17 | 200 | 12 | 420 |
| 34 | 5 | 1260 | 820 | 640 | 27 | 52 | 810 | 31 | 210 | 16 | 390 |
| 35 | 11 | 1250 | 820 | 420 | 42 | 65 | 850 | 29 | 200 | 16 | 400 |
| 36 | 13 | 1170 | 870 | 600 | 26 | 70 | 810 | 31 | 230 | 10 | 380 |
| 37 | 14 | 1220 | 920 | 510 | 33 | 60 | 840 | 21 | 260 | 14 | 430 |
| 38 | 15 | 1260 | 850 | 500 | 39 | 49 | 820 | 24 | 270 | 10 | 440 |
| 39 | 16 | 1270 | 840 | 370 | 34 | 65 | 800 | 21 | 310 | 13 | 420 |
| 40 | 17 | 1280 | 850 | 380 | 41 | 62 | 830 | 30 | 100 | 14 | 400 |
| 41 | 18 | 1190 | 820 | 650 | 25 | 67 | 830 | 33 | 310 | 9 | 380 |

TABLE 3-continued

| | | | | | | | | | | | |
|---|---|---|---|---|---|---|---|---|---|---|---|
| 42 | 19 | 1280 | 920 | 380 | 27 | 48 | 830 | 33 | 210 | 14 | 400 |
| 43 | 20 | 1260 | 870 | 640 | 43 | 63 | 820 | 35 | 180 | 12 | 390 |
| 44 | 21 | 1260 | 890 | 500 | 33 | 50 | 850 | 29 | 220 | 16 | 400 |
| 45 | 22 | 1170 | 820 | 470 | 34 | 49 | 820 | 20 | 200 | 5 | 440 |
| 46 | 23 | 1270 | 890 | 460 | 25 | 66 | 850 | 20 | 210 | 14 | 450 |
| 47 | 24 | 1170 | 900 | 360 | 40 | 51 | 820 | 21 | 220 | 15 | 440 |
| 48 | 25 | 1230 | 900 | 580 | 31 | 48 | 810 | 22 | 230 | 9 | 410 |
| 49 | 26 | 1130 | 880 | 550 | 42 | 70 | 830 | 28 | 230 | 18 | 450 |
| 50 | 27 | 1280 | 830 | 400 | 29 | 62 | 830 | 31 | 240 | 6 | 440 |
| 51 | 28 | 1170 | 890 | 460 | 37 | 49 | 850 | 18 | 230 | 12 | 430 |
| 52 | 29 | 1200 | 820 | 360 | 41 | 50 | 810 | 28 | 230 | 14 | 450 |
| 53 | 30 | 1160 | 870 | 420 | 31 | 53 | 840 | 33 | 240 | 16 | 440 |
| 54 | 31 | 1130 | 930 | 420 | 26 | 47 | 830 | 23 | 230 | 18 | 370 |
| 55 | 32 | 1170 | 860 | 590 | 36 | 53 | 840 | 17 | 240 | 16 | 380 |
| 56 | 33 | 1140 | 920 | 400 | 44 | 67 | 840 | 35 | 230 | 14 | 380 |
| 57 | 34 | 1170 | 830 | 540 | 29 | 59 | 820 | 34 | 220 | 17 | 420 |
| 58 | 35 | 1140 | 910 | 470 | 32 | 57 | 850 | 33 | 230 | 18 | 410 |
| 59 | 36 | 1210 | 880 | 530 | 27 | 61 | 820 | 25 | 210 | 17 | 400 |
| 60 | 37 | 1220 | 820 | 580 | 30 | 68 | 810 | 21 | 220 | 6 | 410 |

| | Annealing conditions Second soaking | | | | MS − | | | |
|---|---|---|---|---|---|---|---|---|
| No. | Second holding time (s) | *7 (° C.) | *8 (%) | Ms (° C.) | 100° C. (° C.) | *9 (° C.) | Surface | Note |
| 31 | 360 | 16 | 73 | 209 | 109 | 59 | CR | Comparative steel |
| 32 | 1000 | 6 | 61 | 310 | 210 | 50 | CR | Comparative steel |
| 33 | 5 | 8 | 68 | 251 | 151 | 51 | CR | Comparative steel |
| 34 | 880 | 25 | 65 | 262 | 162 | 52 | CR | Conforming steel |
| 35 | 820 | 31 | 65 | 257 | 157 | 57 | CR | Comparative steel |
| 36 | 420 | 11 | 60 | 314 | 214 | 84 | CR | Conforming steel |
| 37 | 650 | 14 | 54 | 344 | 244 | 84 | CR | Conforming steel |
| 38 | 490 | 15 | 51 | 362 | 262 | 92 | CR | Conforming steel |
| 39 | 600 | 17 | 44 | 396 | 296 | 86 | CR | Comparative steel |
| 40 | 1150 | 6 | 75 | 156 | 56 | 56 | CR | Comparative steel |
| 41 | 910 | 7 | 49 | 395 | 295 | 85 | CR | Comparative steel |
| 42 | 700 | 6 | 63 | 282 | 182 | 72 | CR | Conforming steel |
| 43 | 660 | 18 | 65 | 271 | 171 | 91 | CR | Conforming steel |
| 44 | 800 | 13 | 64 | 284 | 184 | 64 | CR | Conforming steel |
| 45 | 210 | 12 | 60 | 288 | 188 | 88 | CR | Comparative steel |
| 46 | 750 | 12 | 61 | 302 | 202 | 92 | CR | Conforming steel |
| 47 | 210 | 10 | 59 | 297 | 197 | 77 | CR | Conforming steel |
| 48 | 610 | 18 | 58 | 318 | 218 | 88 | CR | Conforming steel |
| 49 | 430 | 13 | 53 | 324 | 224 | 94 | CR | Conforming steel |
| 50 | 1200 | 11 | 62 | 295 | 195 | 55 | CR | Conforming steel |
| 51 | 160 | 12 | 55 | 311 | 211 | 81 | CR | Conforming steel |
| 52 | 270 | 15 | 54 | 316 | 216 | 86 | CR | Conforming steel |
| 53 | 800 | 9 | 58 | 297 | 197 | 57 | CR | Conforming steel |
| 54 | 320 | 10 | 54 | 324 | 224 | 94 | CR | Conforming steel |
| 55 | 330 | 9 | 57 | 321 | 221 | 81 | CR | Conforming steel |
| 56 | 710 | 6 | 59 | 308 | 208 | 78 | CR | Conforming steel |
| 57 | 170 | 6 | 57 | 307 | 207 | 87 | CR | Conforming steel |
| 58 | 680 | 6 | 57 | 309 | 209 | 79 | CR | Conforming steel |
| 59 | 650 | 14 | 58 | 299 | 199 | 89 | CR | Conforming steel |
| 60 | 550 | 18 | 59 | 314 | 214 | 94 | CR | Conforming steel |

*1: Steel slab heating temperature,

*2: Finish rolling exit temperature,

*3: Average coiling temperature,

*4: Difference in coiling temperature in sheet width direction

*5: Average cooling rate to 500° C.,

*6: Difference in cooling stop temperature in sheet width direction,

*7: Difference in second soaking temperature in sheet width direction

*8: Ferrite fraction at Ms during cooling,

*9: Temperature difference between cooling stop temperature and Ms

TABLE 4

| | | | | | | Cold rolling | Annealing conditions | | | | |
|---|---|---|---|---|---|---|---|---|---|---|---|
| | | | | | | | First soaking | | | | Second soaking |
| | | Hot rolling | | | | Rolling | First soaking | | Cooling stop | | Second soaking |
| No. | Steel type | *1 (° C.) | *2 (° C.) | *3 (° C.) | *4 (° C.) | reduction (%) | temperature (° C.) | *5 (° C./s) | temperature (° C.) | *6 (° C.) | temperature (° C.) |
| 61 | 38 | 1130 | 820 | 430 | 34 | 61 | 840 | 20 | 230 | 5 | 390 |
| 62 | 39 | 1230 | 910 | 540 | 42 | 47 | 840 | 17 | 230 | 15 | 400 |
| 63 | 40 | 1270 | 930 | 390 | 31 | 43 | 820 | 28 | 210 | 8 | 420 |
| 64 | 21 | 1260 | 870 | 500 | 31 | 50 | 840 | 29 | 220 | 15 | 400 |
| 65 | 23 | 1270 | 870 | 460 | 22 | 66 | 840 | 20 | 210 | 13 | 430 |
| 66 | 24 | 1170 | 880 | 360 | 38 | 51 | 810 | 21 | 220 | 14 | 440 |
| 67 | 25 | 1230 | 880 | 580 | 29 | 48 | 800 | 22 | 230 | 10 | 410 |
| 68 | 26 | 1130 | 860 | 550 | 43 | 70 | 820 | 28 | 210 | 17 | 430 |
| 69 | 27 | 1280 | 830 | 400 | 27 | 62 | 820 | 31 | 240 | 7 | 400 |
| 70 | 28 | 1170 | 870 | 460 | 34 | 49 | 840 | 18 | 230 | 10 | 430 |
| 71 | 29 | 1200 | 820 | 360 | 42 | 50 | 800 | 28 | 250 | 12 | 430 |
| 72 | 30 | 1160 | 850 | 420 | 33 | 53 | 830 | 33 | 240 | 16 | 400 |
| 73 | 31 | 1130 | 900 | 420 | 25 | 47 | 820 | 23 | 230 | 18 | 390 |
| 74 | 21 | 1260 | 870 | 500 | 33 | 50 | 830 | 27 | 220 | 16 | 400 |
| 75 | 32 | 1170 | 840 | 590 | 36 | 53 | 820 | 17 | 240 | 16 | 380 |
| 76 | 33 | 1140 | 900 | 400 | 44 | 67 | 820 | 33 | 230 | 13 | 380 |
| 77 | 34 | 1170 | 830 | 540 | 29 | 59 | 800 | 33 | 220 | 16 | 420 |
| 78 | 35 | 1140 | 890 | 470 | 32 | 57 | 830 | 32 | 230 | 17 | 410 |
| 79 | 36 | 1210 | 860 | 530 | 27 | 61 | 800 | 25 | 210 | 17 | 400 |
| 80 | 37 | 1220 | 820 | 580 | 30 | 68 | 790 | 20 | 220 | 5 | 410 |
| 81 | 38 | 1130 | 820 | 430 | 34 | 61 | 820 | 20 | 230 | 6 | 390 |
| 82 | 39 | 1230 | 890 | 540 | 42 | 47 | 820 | 17 | 230 | 15 | 400 |
| 83 | 40 | 1270 | 900 | 390 | 31 | 43 | 800 | 26 | 210 | 8 | 420 |

| | Annealing conditions Second soaking | | | | MS – | | | |
|---|---|---|---|---|---|---|---|---|
| No. | Second holding time (s) | *7 (° C.) | *8 (%) | Ms (° C.) | 100° C. (° C.) | *9 (° C.) | Surface | Note |
| 61 | 420 | 16 | 52 | 322 | 222 | 92 | CR | Conforming steel |
| 62 | 920 | 10 | 60 | 312 | 212 | 82 | CR | Conforming steel |
| 63 | 400 | 10 | 61 | 298 | 198 | 88 | CR | Conforming steel |
| 64 | 550 | 11 | 65 | 269 | 169 | 49 | GI | Conforming steel |
| 65 | 500 | 13 | 66 | 271 | 171 | 61 | GI | Conforming steel |
| 66 | 450 | 10 | 64 | 262 | 162 | 42 | GI | Conforming steel |
| 67 | 400 | 17 | 64 | 283 | 183 | 53 | GI | Conforming steel |
| 68 | 380 | 15 | 59 | 297 | 197 | 67 | GI | Conforming steel |
| 69 | 520 | 11 | 67 | 260 | 160 | 20 | GI | Conforming steel |
| 70 | 500 | 10 | 59 | 285 | 185 | 55 | GI | Conforming steel |
| 71 | 520 | 12 | 57 | 328 | 228 | 78 | GI | Conforming steel |
| 72 | 320 | 12 | 62 | 266 | 166 | 26 | GI | Conforming steel |
| 73 | 350 | 13 | 60 | 277 | 177 | 47 | GI | Conforming steel |
| 74 | 560 | 12 | 67 | 256 | 156 | 36 | GA | Conforming steel |
| 75 | 430 | 11 | 58 | 297 | 197 | 57 | GA | Conforming steel |
| 76 | 460 | 7 | 62 | 272 | 172 | 42 | GA | Conforming steel |
| 77 | 420 | 6 | 59 | 308 | 208 | 88 | GA | Conforming steel |
| 78 | 500 | 6 | 60 | 302 | 202 | 72 | GA | Conforming steel |
| 79 | 460 | 12 | 60 | 288 | 188 | 78 | GA | Conforming steel |
| 80 | 550 | 17 | 62 | 277 | 177 | 57 | GA | Conforming steel |
| 81 | 420 | 15 | 55 | 319 | 219 | 89 | GA | Conforming steel |
| 82 | 490 | 11 | 62 | 295 | 195 | 65 | GA | Conforming steel |
| 83 | 400 | 9 | 63 | 251 | 151 | 41 | GA | Conforming steel |

*1: Steel slab heating temperature,
*2: Finish rolling exit temperature,
*3: Average coiling temperature,
*4: Difference in coiling temperature in sheet width direction
*5: Average cooling rate to 500° C.,
*6: Difference in cooling stop temperature in sheet width direction,
*7: Difference in second soaking temperature in sheet width direction
*8: Ferrite fraction at Ms during cooling,
*9: Temperature difference between cooling stop temperature and Ms

TABLE 5

| | | Steel microstructure* | | | | | | | |
|---|---|---|---|---|---|---|---|---|---|
| | | F | M | | | RA | TM | | Area fraction ratio |
| No. | Steel type | Area fraction (%) | Area fraction (%) | Average grain size (μm) | Standard deviation of grain size (μm) | Area fraction (%) | Area fraction (%) | Residual microstructure | $f_M/f_{M+TM}$ (%) |
| 1 | 1 | 53 | 7 | 2.2 | 0.5 | 5 | 35 | — | 17 |
| 2 | 2 | 55 | 7 | 1.9 | 0.4 | 6 | 32 | — | 18 |
| 3 | 3 | 58 | 6 | 1.7 | 0.4 | 7 | 29 | — | 17 |
| 4 | 4 | 61 | 5 | 1.5 | 0.4 | 8 | 26 | — | 16 |
| 5 | 5 | 71 | 5 | 1.6 | 0.4 | 11 | 13 | — | 28 |
| 6 | 6 | 72 | 4 | 1.9 | 0.5 | 13 | 11 | — | 27 |
| 7 | 7 | 73 | 3 | 2.1 | 0.6 | 14 | 10 | — | 23 |
| 8 | 8 | 70 | 3 | 2.3 | 0.6 | 16 | 8 | P | 27 |
| 9 | 9 | 72 | 7 | 1.9 | 0.4 | 5 | 16 | — | 30 |
| 10 | 10 | 68 | 7 | 2.2 | 0.5 | 6 | 19 | — | 27 |
| 11 | 11 | 69 | 6 | 1.7 | 0.5 | 8 | 17 | — | 26 |
| 12 | 12 | 70 | 5 | 1.2 | 0.3 | 10 | 15 | — | 25 |
| 13 | 24 | 71 | 5 | 2.7 | 0.5 | 11 | 13 | — | 28 |
| 14 | 11 | 73 | 5 | 1.5 | 0.8 | 7 | 15 | — | 25 |
| 15 | 12 | 81 | 2 | 2.3 | 0.7 | 6 | 11 | — | 15 |
| 16 | 13 | 56 | 9 | 2.2 | 0.6 | 10 | 25 | — | 26 |
| 17 | 19 | 82 | 2 | 1.7 | 0.6 | 7 | 9 | — | 18 |
| 18 | 5 | 72 | 4 | 1.5 | 0.6 | 10 | 14 | — | 22 |
| 19 | 11 | 69 | 6 | 1.8 | 0.7 | 9 | 16 | — | 27 |
| 20 | 13 | 65 | 6 | 1.4 | 0.8 | 11 | 18 | — | 25 |
| 21 | 12 | 66 | 8 | 1.2 | 0.8 | 11 | 15 | — | 35 |
| 22 | 19 | 69 | 5 | 1.1 | 0.4 | 11 | 15 | — | 25 |
| 23 | 5 | 89 | 2 | 1.6 | 0.4 | 1 | 8 | — | 20 |
| 24 | 11 | 22 | 8 | 2.4 | 0.7 | 5 | 65 | — | 11 |
| 25 | 13 | 81 | 2 | 1.3 | 0.3 | 8 | 9 | — | 18 |
| 26 | 19 | 64 | 6 | 1.4 | 0.5 | 10 | 20 | — | 23 |
| 27 | 12 | 52 | 2 | 1.3 | 0.3 | 4 | 42 | — | 5 |
| 28 | 12 | 76 | 12 | 1.7 | 0.5 | 10 | 2 | — | 86 |
| 29 | 5 | 70 | 6 | 1.6 | 0.7 | 11 | 13 | — | 32 |
| 30 | 11 | 67 | 6 | 1.7 | 0.8 | 9 | 18 | — | 25 |

| | Mechanical characteristics | | | | | | | |
|---|---|---|---|---|---|---|---|---|
| No. | YS (MPa) | TS (MPa) | EI (%) | λ (%) | TS · EI (MPa · %) | TS · λ (MPa · %) | Standard deviation of λ (%) | Note |
| 1 | 602 | 962 | 20 | 33 | 19240 | 31746 | 3 | Comparative steel |
| 2 | 611 | 972 | 21 | 32 | 20412 | 31104 | 3 | Conforming steel |
| 3 | 598 | 951 | 22 | 35 | 20922 | 33285 | 2 | Conforming steel |
| 4 | 585 | 929 | 23 | 38 | 21367 | 35302 | 2 | Conforming steel |
| 5 | 497 | 814 | 28 | 44 | 22792 | 35816 | 3 | Conforming steel |
| 6 | 481 | 801 | 29 | 43 | 23229 | 34443 | 3 | Conforming steel |
| 7 | 458 | 788 | 29 | 41 | 22852 | 32308 | 3 | Conforming steel |
| 8 | 431 | 752 | 26 | 38 | 19552 | 28576 | 3 | Comparative steel |
| 9 | 492 | 806 | 24 | 40 | 19344 | 32240 | 3 | Comparative steel |
| 10 | 500 | 815 | 25 | 42 | 20375 | 34230 | 2 | Conforming steel |
| 11 | 508 | 824 | 26 | 44 | 21424 | 36256 | 2 | Conforming steel |
| 12 | 517 | 834 | 27 | 45 | 22518 | 37530 | 3 | Conforming steel |
| 13 | 417 | 807 | 26 | 36 | 20982 | 29052 | 2 | Comparative steel |
| 14 | 493 | 804 | 27 | 45 | 21708 | 36180 | 5 | Comparative steel |
| 15 | 423 | 742 | 26 | 45 | 19292 | 33390 | 2 | Comparative steel |
| 16 | 702 | 972 | 22 | 30 | 21384 | 29160 | 3 | Comparative steel |
| 17 | 405 | 725 | 30 | 45 | 21750 | 32625 | 2 | Comparative steel |
| 18 | 488 | 807 | 28 | 45 | 22596 | 36315 | 3 | Conforming steel |
| 19 | 516 | 830 | 27 | 45 | 22410 | 37350 | 4 | Conforming steel |
| 20 | 594 | 862 | 26 | 45 | 22412 | 38790 | 5 | Comparative steel |
| 21 | 652 | 904 | 27 | 37 | 24408 | 33448 | 5 | Comparative steel |
| 22 | 510 | 845 | 27 | 41 | 22815 | 34645 | 4 | Conforming steel |
| 23 | 503 | 671 | 30 | 45 | 20130 | 30195 | 2 | Comparative steel |
| 24 | 804 | 999 | 12 | 42 | 11988 | 41958 | 3 | Comparative steel |
| 25 | 508 | 745 | 30 | 45 | 22350 | 33525 | 2 | Comparative steel |
| 26 | 832 | 872 | 26 | 45 | 22672 | 39240 | 3 | Conforming steel |
| 27 | 614 | 920 | 21 | 38 | 19320 | 34960 | 3 | Comparative steel |
| 28 | 499 | 823 | 28 | 30 | 23044 | 24690 | 2 | Comparative steel |
| 29 | 503 | 819 | 27 | 43 | 22113 | 35217 | 4 | Conforming steel |
| 30 | 509 | 831 | 27 | 45 | 22437 | 37395 | 5 | Comparative steel |

*F: ferrite, M: martensite, TM: tempered martensite, RA: retained austenite, P: pearlite

TABLE 6

| | | Steel microstructure* | | | | | | | |
|---|---|---|---|---|---|---|---|---|---|
| No. | Steel type | F Area fraction (%) | MArea fraction (%) | Average grain size (μm) | Standard deviation of grain size (μm) | RA Area fraction (%) | TM Area fraction (%) | Residual microstructure | Area fraction ratio $f_M/f_{M+TM}$ (%) |
| 31 | 12 | 75 | 8 | 2.0 | 0.5 | 10 | 7 | — | 53 |
| 32 | 13 | 65 | 5 | 1.0 | 0.4 | 3 | 15 | P | 25 |
| 33 | 19 | 70 | 10 | 2.6 | 0.5 | 5 | 15 | — | 40 |
| 34 | 5 | 71 | 5 | 1.5 | 0.7 | 10 | 14 | — | 26 |
| 35 | 11 | 69 | 6 | 1.6 | 0.8 | 9 | 16 | — | 27 |
| 36 | 13 | 64 | 6 | 1.5 | 0.4 | 10 | 20 | — | 23 |
| 37 | 14 | 59 | 7 | 1.6 | 0.5 | 9 | 25 | — | 22 |
| 38 | 15 | 55 | 7 | 1.7 | 0.5 | 8 | 30 | — | 19 |
| 39 | 16 | 48 | 8 | 1.8 | 0.6 | 7 | 37 | — | 18 |
| 40 | 17 | 81 | 1 | 2.2 | 0.6 | 13 | 5 | — | 17 |
| 41 | 18 | 53 | 9 | 2.3 | 0.5 | 6 | 32 | — | 22 |
| 42 | 19 | 69 | 6 | 1.2 | 0.4 | 10 | 15 | — | 29 |
| 43 | 20 | 68 | 6 | 1.4 | 0.5 | 11 | 15 | — | 29 |
| 44 | 21 | 67 | 6 | 1.5 | 0.5 | 12 | 15 | — | 29 |
| 45 | 22 | 66 | 6 | 1.6 | 0.6 | 13 | 15 | — | 29 |
| 46 | 23 | 65 | 7 | 2.0 | 0.5 | 8 | 20 | — | 26 |
| 47 | 24 | 63 | 6 | 1.8 | 0.4 | 10 | 21 | — | 22 |
| 48 | 25 | 63 | 6 | 2.0 | 0.6 | 8 | 23 | — | 21 |
| 49 | 26 | 57 | 6 | 1.5 | 0.4 | 12 | 25 | — | 19 |
| 50 | 27 | 66 | 5 | 1.8 | 0.5 | 9 | 20 | — | 20 |
| 51 | 28 | 59 | 7 | 1.7 | 0.6 | 10 | 24 | — | 23 |
| 52 | 29 | 58 | 6 | 1.7 | 0.5 | 11 | 25 | — | 19 |
| 53 | 30 | 62 | 5 | 1.6 | 0.4 | 8 | 25 | — | 17 |
| 54 | 31 | 58 | 7 | 1.5 | 0.4 | 10 | 25 | — | 22 |
| 55 | 32 | 61 | 7 | 1.8 | 0.6 | 11 | 21 | — | 25 |
| 56 | 33 | 63 | 7 | 1.8 | 0.5 | 8 | 22 | — | 24 |
| 57 | 34 | 61 | 6 | 1.5 | 0.6 | 11 | 22 | — | 21 |
| 58 | 35 | 61 | 6 | 1.6 | 0.5 | 9 | 24 | — | 20 |
| 59 | 36 | 62 | 7 | 1.9 | 0.5 | 8 | 23 | — | 23 |
| 60 | 37 | 63 | 5 | 1.5 | 0.6 | 10 | 22 | — | 19 |

| | Mechanical characteristics | | | | | | | |
|---|---|---|---|---|---|---|---|---|
| No. | YS (MPa) | TS (MPa) | EI (%) | λ (%) | TS · I (MPa · %) | TS · λ (MPa · %) | Standard deviation of λ (%) | Note |
| 31 | 488 | 831 | 27 | 35 | 22437 | 29085 | 3 | Comparative steel |
| 32 | 460 | 723 | 26 | 45 | 18798 | 32535 | 3 | Comparative steel |
| 33 | 521 | 867 | 23 | 33 | 19941 | 28611 | 2 | Comparative steel |
| 34 | 502 | 812 | 28 | 43 | 22736 | 34916 | 4 | Conforming steel |
| 35 | 508 | 831 | 27 | 43 | 22437 | 35733 | 5 | Comparative steel |
| 36 | 600 | 872 | 25 | 46 | 21800 | 40112 | 3 | Conforming steel |
| 37 | 682 | 922 | 23 | 47 | 21206 | 43334 | 2 | Conforming steel |
| 38 | 765 | 971 | 21 | 48 | 20391 | 46608 | 3 | Conforming steel |
| 39 | 850 | 1020 | 18 | 50 | 18360 | 51000 | 3 | Comparative steel |
| 40 | 416 | 734 | 29 | 45 | 21286 | 33030 | 2 | Comparative steel |
| 41 | 595 | 990 | 21 | 30 | 20790 | 29700 | 3 | Comparative steel |
| 42 | 515 | 850 | 27 | 43 | 22950 | 36550 | 2 | Conforming steel |
| 43 | 521 | 858 | 26 | 41 | 22308 | 35178 | 3 | Conforming steel |
| 44 | 526 | 867 | 25 | 39 | 21675 | 33813 | 3 | Conforming steel |
| 45 | 529 | 875 | 22 | 37 | 19250 | 32375 | 3 | Comparative steel |
| 46 | 581 | 916 | 25 | 46 | 22900 | 42136 | 3 | Conforming steel |
| 47 | 598 | 879 | 25 | 48 | 21975 | 42192 | 3 | Conforming steel |
| 48 | 591 | 898 | 23 | 45 | 20654 | 40410 | 2 | Conforming steel |
| 49 | 600 | 912 | 23 | 48 | 20976 | 43776 | 3 | Conforming steel |
| 50 | 599 | 914 | 25 | 45 | 22850 | 41130 | 2 | Conforming steel |
| 51 | 580 | 881 | 23 | 47 | 20263 | 41407 | 2 | Conforming steel |
| 52 | 590 | 910 | 24 | 47 | 21840 | 42770 | 3 | Conforming steel |
| 53 | 590 | 888 | 24 | 46 | 21312 | 40848 | 3 | Conforming steel |
| 54 | 598 | 894 | 25 | 45 | 22350 | 40230 | 3 | Conforming steel |
| 55 | 599 | 873 | 24 | 45 | 20952 | 39285 | 3 | Conforming steel |
| 56 | 586 | 881 | 25 | 45 | 22025 | 39645 | 3 | Conforming steel |
| 57 | 597 | 928 | 24 | 47 | 22272 | 43616 | 2 | Conforming steel |
| 58 | 596 | 885 | 24 | 46 | 21240 | 40710 | 3 | Conforming steel |
| 59 | 580 | 881 | 24 | 48 | 21144 | 42288 | 3 | Conforming steel |
| 60 | 582 | 919 | 23 | 47 | 21137 | 43193 | 2 | Conforming steel |

*F: ferrite, M: martensite, TM: tempered martensite, RA: retained austenite, P: pearlite

TABLE 7

| | | Steel microstructure* | | | | | | | |
|---|---|---|---|---|---|---|---|---|---|
| | | F | M | | | RA | TM | | Area fraction ratio |
| No. | Steel type | Area fraction (%) | Area fraction (%) | Average grain size (μm) | Standard deviation of grain size (μm) | Area fraction (%) | Area fraction (%) | Residual microstructure | $f_M/f_{M+TM}$ (%) |
| 61 | 38 | 56 | 7 | 1.8 | 0.6 | 12 | 25 | — | 22 |
| 62 | 39 | 64 | 5 | 1.5 | 0.6 | 11 | 20 | — | 20 |
| 63 | 40 | 65 | 6 | 2.0 | 0.5 | 8 | 21 | — | 22 |
| 64 | 21 | 70 | 6 | 1.7 | 0.5 | 8 | 16 | — | 27 |
| 65 | 23 | 67 | 8 | 2.0 | 0.6 | 7 | 18 | — | 31 |
| 66 | 24 | 66 | 5 | 1.9 | 0.4 | 9 | 20 | — | 20 |
| 67 | 25 | 65 | 6 | 2.1 | 0.5 | 8 | 21 | — | 22 |
| 68 | 26 | 64 | 7 | 1.7 | 0.4 | 11 | 18 | — | 28 |
| 69 | 27 | 68 | 4 | 2.0 | 0.5 | 9 | 19 | — | 17 |
| 70 | 28 | 62 | 7 | 2.0 | 0.6 | 9 | 22 | — | 24 |
| 71 | 29 | 61 | 6 | 1.8 | 0.6 | 10 | 23 | — | 21 |
| 72 | 30 | 65 | 4 | 1.8 | 0.4 | 8 | 23 | — | 15 |
| 73 | 31 | 61 | 7 | 1.7 | 0.4 | 9 | 23 | — | 23 |
| 74 | 21 | 72 | 7 | 1.7 | 0.5 | 8 | 13 | — | 35 |
| 75 | 32 | 66 | 7 | 1.9 | 0.6 | 9 | 18 | — | 28 |
| 76 | 33 | 68 | 6 | 2.0 | 0.5 | 7 | 19 | — | 24 |
| 77 | 34 | 66 | 6 | 1.6 | 0.6 | 9 | 19 | — | 24 |
| 78 | 35 | 66 | 5 | 1.8 | 0.5 | 8 | 21 | — | 19 |
| 79 | 36 | 67 | 4 | 2.0 | 0.5 | 7 | 22 | — | 15 |
| 80 | 37 | 68 | 7 | 1.7 | 0.6 | 6 | 19 | — | 27 |
| 81 | 38 | 62 | 7 | 2.0 | 0.6 | 7 | 24 | — | 23 |
| 82 | 39 | 69 | 5 | 1.7 | 0.6 | 9 | 17 | — | 23 |
| 83 | 40 | 70 | 5 | 2.1 | 0.5 | 7 | 18 | — | 22 |

| | Mechanical characteristics | | | | | | | |
|---|---|---|---|---|---|---|---|---|
| No. | YS (MPa) | TS (MPa) | EI (%) | λ (%) | TS · EI (MPa · %) | TS · λ (MPa · %) | Standard deviation of λ (%) | Note |
| 61 | 581 | 881 | 24 | 45 | 21144 | 39645 | 3 | Conforming steel |
| 62 | 590 | 887 | 23 | 48 | 20401 | 42576 | 3 | Conforming steel |
| 63 | 589 | 911 | 24 | 46 | 21864 | 41906 | 3 | Conforming steel |
| 64 | 512 | 855 | 25 | 38 | 21375 | 32490 | 3 | Conforming steel |
| 65 | 571 | 902 | 25 | 43 | 22550 | 38786 | 2 | Conforming steel |
| 66 | 583 | 861 | 26 | 41 | 22386 | 35301 | 3 | Conforming steel |
| 67 | 580 | 880 | 24 | 41 | 21120 | 36080 | 2 | Conforming steel |
| 68 | 585 | 900 | 25 | 39 | 22500 | 35100 | 2 | Conforming steel |
| 69 | 584 | 994 | 24 | 41 | 23856 | 40754 | 3 | Conforming steel |
| 70 | 570 | 869 | 25 | 41 | 21725 | 35629 | 2 | Conforming steel |
| 71 | 575 | 998 | 24 | 43 | 23952 | 42914 | 3 | Conforming steel |
| 72 | 581 | 972 | 24 | 41 | 23328 | 39852 | 2 | Conforming steel |
| 73 | 583 | 978 | 24 | 40 | 23472 | 39120 | 3 | Conforming steel |
| 74 | 486 | 846 | 25 | 36 | 21150 | 30456 | 3 | Conforming steel |
| 75 | 567 | 833 | 25 | 38 | 20825 | 31654 | 3 | Conforming steel |
| 76 | 552 | 852 | 26 | 40 | 22152 | 34080 | 3 | Conforming steel |
| 77 | 565 | 879 | 24 | 39 | 21096 | 34281 | 2 | Conforming steel |
| 78 | 562 | 846 | 24 | 40 | 20304 | 33840 | 3 | Conforming steel |
| 79 | 559 | 840 | 25 | 43 | 21000 | 36120 | 3 | Conforming steel |
| 80 | 547 | 872 | 24 | 39 | 20928 | 34008 | 2 | Conforming steel |
| 81 | 542 | 835 | 24 | 36 | 20040 | 30060 | 3 | Conforming steel |
| 82 | 555 | 849 | 24 | 41 | 20376 | 34809 | 3 | Conforming steel |
| 83 | 565 | 881 | 24 | 40 | 21144 | 35240 | 3 | Conforming steel |

*F: ferrite, M: martensite,TM: tempered martensite, RA: retained austenite, P: pearlite

The invention claimed is:

1. A high-strength cold-rolled steel sheet having a chemical composition comprising, by mass %:

C: 0.060% to 0.250%;

Si: 0.50% to 1.80%;

Mn: 1.00% to 2.80%;

P: 0.100% or less;

S: 0.0100% or less;

Al: 0.010% to 0.100%; and

N: 0.0100% or less;

the remainder being Fe and incidental impurities, wherein the steel sheet has a microstructure comprising, by area fraction, in a range of 50% to 80% of ferrite, in a range of 1% to 8% of martensite with an average grain size of 2.5 μm or less, in a range of 6% to 15% of retained austenite, and in a range of 3% to 40% of tempered martensite, a ratio $f_M/f_{M+TM}$ being 50% or less, where $f_M$ denotes an area fraction of martensite and $f_{M+TM}$ denotes a total area fraction of martensite and tempered martensite, and a standard deviation of a grain size of martensite at five portions being 0.7 μm or less, the five portions being a width central portion at a center in a sheet width direction, end portions 50 mm inside each end in the sheet width direction, and middle portions between the width central portion and the end portions, wherein the steel sheet has a tensile strength (TS) of 780 MPa or more, and a standard deviation of hole expanding ratio (λ) of 4% or less.

2. The high-strength cold-rolled steel sheet according to claim 1, wherein the chemical composition further comprises, by mass %, at least one Group selected from the group consisting of:

Group A: at least one element selected from the group consisting of Mo: 0.01% to 0.50%, B: 0.0001% to 0.0050%, and Cr: 0.01% to 0.50%, Group B: at least one element selected from the group consisting of Ti: 0.001% to 0.100%, Nb: 0.001% to 0.050%, and V: 0.001% to 0.100%, and Group C: at least one element selected from the group consisting of Cu: 0.01% to 1.00%, Ni: 0.01% to 0.50%, As: 0.001% to 0.500%, Sb: 0.001% to 0.100%, Sn: 0.001% to 0.100%, Ta: 0.001% to 0.100%, Ca: 0.0001% to 0.0100%, Mg: 0.0001% to 0.0200%, Zn: 0.001% to 0.020%, Co: 0.001% to 0.020%, Zr: 0.001% to 0.020%, and REM: 0.0001% to 0.0200%.

3. A high-strength coated steel sheet comprising:

the high-strength cold-rolled steel sheet according to claim 1; and a coated layer formed on the high-strength cold-rolled steel sheet.

4. The high-strength coated steel sheet according to claim 3, wherein the coated layer is a hot-dip coated layer or an alloyed hot-dip coated layer.

5. A high-strength coated steel sheet comprising:

the high-strength cold-rolled steel sheet according to claim 2; and a coated layer formed on the high-strength cold-rolled steel sheet.

6. The high-strength coated steel sheet according to claim 5, wherein the coated layer is a hot-dip coated layer or an alloyed hot-dip coated layer.

7. A method for producing the high-strength cold-rolled steel sheet according to claim 1, the method comprising:

a hot rolling step of heating a steel slab with a chemical composition according to claim 1 to a temperature in a range of 1100° C. to 1300° C., hot rolling the steel slab at a finish rolling exit temperature in a range of 800° C. to 950° C., and coiling the hot-rolled sheet at a coiling temperature in a range of 300° C. to 700° C. and at a difference of 70° C. or less in coiling temperature in a temperature distribution in a sheet width direction;

after the hot rolling step, a cold rolling step of cold rolling the hot-rolled sheet at a rolling reduction of 30% or more;

after the cold rolling step, a first soaking step of heating the cold-rolled sheet to a first soaking temperature in a range of T1 to T2, and cooling the cold-rolled sheet at an average cooling rate to 500° C. of 10° C./s or more to a cooling stop temperature in a range of (Ms—100° C.) to Ms, where Ms denotes a martensitic transformation start temperature, a difference in cooling stop temperature in the temperature distribution in the sheet width direction during the cooling being 30° C. or less; and after the first soaking step, a second soaking step of reheating the sheet to a second soaking temperature in a range of 350° C. to 500° C., soaking the sheet for 10 seconds or more at a difference of 30° C. or less in second soaking temperature in the temperature distribution in the sheet width direction during the reheating, and cooling the sheet to room temperature, wherein:

$$Ms\ (^\circ C.)=539-423\times\{[\%\ C]/(1-[\%\ \alpha]/100)\}-30\times[\%\ Mn]-12\times[\%\ Cr]-18\times[\%\ Ni]-8\times[\%\ Mo]$$

$$\text{Temperature } T1(^\circ C.)=751-27\times[\%\ C]+18\times[\%\ Si]-12\times[\%\ Mn]-169\times[\%\ Al]-6\times[\%\ Ti]+24\times[\%\ Cr]-895\times[\%\ B]$$

$$\text{Temperature } T2(^\circ C.)=937-477\times[\%\ C]+56\times[\%\ Si]-20\times[\%\ Mn]+198\times[\%\ Al]+136\times[\%\ Ti]-5\times[\%\ Cr]+3315\times[\%\ B]$$

[% X] in the formulae denotes a component element X, by mass %, of the steel sheet, and [% α] denotes a ferrite fraction at Ms during the cooling.

8. A method for producing the high-strength cold-rolled steel sheet according to claim 2, the method comprising:

a hot rolling step of heating a steel slab with a chemical composition according to claim 2 to a temperature in a range of 1100° C. to 1300° C., hot rolling the steel slab at a finish rolling exit temperature in a range of 800° C. to 950° C., and coiling the hot-rolled sheet at a coiling temperature in a range of 300° C. to 700° C. and at a difference of 70° C. or less in coiling temperature in a temperature distribution in a sheet width direction;

after the hot rolling step, a cold rolling step of cold rolling the hot-rolled sheet at a rolling reduction of 30% or more;

after the cold rolling step, a first soaking step of heating the cold-rolled sheet to a first soaking temperature in a range of T1 to T2, and cooling the cold-rolled sheet at an average cooling rate to 500° C. of 10° C./s or more to a cooling stop temperature in a range of (Ms—100° C.) to Ms, where Ms denotes a martensitic transformation start temperature, a difference in cooling stop temperature in the temperature distribution in the sheet width direction during the cooling being 30° C. or less; and after the first soaking step, a second soaking step of reheating the sheet to a second soaking temperature in a range of 350° C. to 500° C., soaking the sheet for 10 seconds or more at a difference of 30° C. or less in second soaking temperature in the temperature distribution in the sheet width direction during the reheating, and cooling the sheet to room temperature, wherein:

$$Ms\ (^\circ C.)=539-423\times\{[\%\ C]/(1-[\%\ \alpha]/100)\}-30\times[\%\ Mn]-12\times[\%\ Cr]-18\times[\%\ Ni]-8\times[\%\ Mo]$$

$$\text{Temperature } T1(^\circ C.)=751-27\times[\%\ C]+18\times[\%\ Si]-12\times[\%\ Mn]-169\times[\%\ Al]-6\times[\%\ Ti]+24\times[\%\ Cr]-895\times[\%\ B]$$

$$\text{Temperature } T2(^\circ C.)=937-477\times[\%\ C]+56\times[\%\ Si]-20\times[\%\ Mn]+198\times[\%\ Al]+136\times[\%\ Ti]-5\times[\%\ Cr]+3315\times[\%\ B]$$

[% X] in the formulae denotes a component element X content, by mass %, of the steel sheet, and [% α] denotes a ferrite fraction at Ms during the cooling.

9. A method for producing a high-strength coated steel sheet, the method comprising a coating step of coating a high-strength cold-rolled steel sheet produced by the method for producing a high-strength cold-rolled steel sheet according to claim 7.

10. The method for producing a high-strength coated steel sheet according to claim 9, further comprising an alloying step of performing alloying treatment after the coating step.

11. A method for producing a high-strength coated steel sheet, the method comprising a coating step of coating a high-strength cold-rolled steel sheet produced by the method for producing a high-strength cold-rolled steel sheet according to claim 8.

12. The method for producing a high-strength coated steel sheet according to claim 11, further comprising an alloying step of performing alloying treatment after the coating step.

* * * * *